US008731950B2

(12) United States Patent
Herre et al.

(10) Patent No.: US 8,731,950 B2
(45) Date of Patent: May 20, 2014

(54) APPARATUS FOR PROVIDING ONE OR MORE ADJUSTED PARAMETERS FOR A PROVISION OF AN UPMIX SIGNAL REPRESENTATION ON THE BASIS OF A DOWNMIX SIGNAL REPRESENTATION, AUDIO SIGNAL DECODER, AUDIO SIGNAL TRANSCODER, AUDIO SIGNAL ENCODER, AUDIO BITSTREAM, METHOD AND COMPUTER PROGRAM USING AN OBJECT-RELATED PARAMETRIC INFORMATION

(75) Inventors: Juergen Herre, Buckenhof (DE); Andreas Hoelzer, Erlangen (DE); Leonid Terentiev, Erlangen (DE); Thorsten Kastner, Stockheim/Reitsch (DE); Cornelia Falch, Nuremberg (DE); Heiko Purnhagen, Sundbyberg (SE); Jonas Engdegard, Stockholm (SE); Falko Ridderbusch, Nuremberg (DE)

(73) Assignees: Fraunhofer-Gesellschaft zur Foerderung der Angewandten Forschung E.V., Munich (DE); Dolby International AB, Amsterdam Zuid-Oost (NL); Friedrich-Alexander-Universitaet Erlangen-Nuernberg, Erlangen (DE)

( * ) Notice: Subject to any disclaimer, the term of this patent is extended or adjusted under 35 U.S.C. 154(b) by 0 days.

(21) Appl. No.: 13/284,583

(22) Filed: Oct. 28, 2011

(65) Prior Publication Data

US 2012/0143613 A1 Jun. 7, 2012

Related U.S. Application Data

(63) Continuation of application No. PCT/EP2010/055717, filed on Apr. 28, 2010.

(60) Provisional application No. 61/173,456, filed on Apr. 28, 2009.

(51) Int. Cl.
*G10L 19/00* (2013.01)

(52) U.S. Cl.
USPC ..... 704/500; 704/200; 704/200.1

(58) Field of Classification Search
USPC ..... 704/200–201, 500–504
See application file for complete search history.

(56) References Cited

U.S. PATENT DOCUMENTS 7,983,922 B2 * 7/2011 Neusinger et al. ..... 704/500

(Continued)

FOREIGN PATENT DOCUMENTS

EP 2 175 670 4/2010

(Continued)

OTHER PUBLICATIONS

"Information technology—MPEG audio technologies—Part 2: Spatial Audio Object Coding (SAOC)", ISO/IEC JTC 1/SC 29 N; ISO/IEC FCS 23003-2.2, Jul. 25, 2008, 113 Pages.

(Continued)

*Primary Examiner* — Douglas Godbold
(74) *Attorney, Agent, or Firm* — Michael A. Glenn; Perkins Coie LLP

(57) ABSTRACT

An apparatus for providing one or more adjusted parameters for a provision of an upmix signal representation on the basis of a downmix signal representation and an object-related parametric information includes a parameter adjuster. The parameter adjuster is configured to receive one or more input parameters and to provide, on the basis thereof, one or more adjusted parameters. The parameter adjuster is configured to provide the one or more adjusted parameters in dependence on the one or more input parameters and the object-related parametric information, such that a distortion of the upmix signal representation caused by the use of non-optimal parameters is reduced at least for input parameters deviating from optimal parameters by more than a predetermined deviation.

28 Claims, 12 Drawing Sheets

(56) References Cited

U.S. PATENT DOCUMENTS

| | | | | |
|---|---|---|---|---|
| 8,204,756 | B2 * | 6/2012 | Kim et al. | 704/501 |
| 8,208,641 | B2 * | 6/2012 | Oh et al. | 381/22 |
| 2008/0002842 | A1 * | 1/2008 | Neusinger et al. | 381/119 |
| 2008/0262853 | A1 * | 10/2008 | Jung et al. | 704/500 |
| 2009/0326958 | A1 * | 12/2009 | Kim et al. | 704/500 |
| 2010/0076774 | A1 * | 3/2010 | Breebaart | 704/503 |
| 2010/0198602 | A1 * | 8/2010 | Oh et al. | 704/500 |

FOREIGN PATENT DOCUMENTS

| | | |
|---|---|---|
| WO | 2008/035275 | 3/2008 |
| WO | 2008/084427 | 7/2008 |
| WO | WO-2008100067 | 8/2008 |
| WO | WO-2008100068 | 8/2008 |
| WO | 2009/049895 | 4/2009 |
| WO | WO-2011048067 | 4/2011 |
| WO | WO-2011061174 | 5/2011 |

OTHER PUBLICATIONS

Engdegard, J. et al., "Spatial audio object coding (SAOC) the upcoming MPEG standard on parametric object based audio coding", 124th AES Convention, AES Convention Paper, Amsterdam, The Netherlands, May 17-20, 2008, 15 pages.

Faller, et al., "Binaural Cue Coding—Part II: Schemes and Applications", IEEE Transactions on Speech and Audio Processing, vol. 11, No. 6, Nov. 2003, pp. 520-531.

Faller, C. , "Parametric Joint-Coding of Audio Sources", AES Convention Paper 6752, Presented at the 120th Convention, Paris, France, May 20-23, 2006, 12 pages.

Herre, et al., "From SAC to SAOC—Recent Developments in Parametric Coding of Spatial Audio", Illusions in Sound, AES 22nd UK Conference, Apr. 2007, 8 pages.

* cited by examiner (A) MOMO DOWNMIX BASED TRANSCODER (B) STEREO DOWNMIX BASED TRANSCODER

MPEG SAOC SYSTEM OVERVIEW

SEPARATE DECODER AND MIXER

INTEGRATED DECODER AND MIXER

APPARATUS FOR PROVIDING ONE OR MORE ADJUSTED PARAMETERS FOR A PROVISION OF AN UPMIX SIGNAL REPRESENTATION ON THE BASIS OF A DOWNMIX SIGNAL REPRESENTATION, AUDIO SIGNAL DECODER, AUDIO SIGNAL TRANSCODER, AUDIO SIGNAL ENCODER, AUDIO BITSTREAM, METHOD AND COMPUTER PROGRAM USING AN OBJECT-RELATED PARAMETRIC INFORMATION

CROSS-REFERENCE TO RELATED APPLICATIONS

This application is a continuation of copending International Application No. PCT/EP2010/055717, filed Apr. 28, 2010, which is incorporated herein by reference in its entirety, and additionally claims priority from U.S. Patent Application No. 61/173,456, filed Apr. 28, 2009, which is also incorporated herein by reference in its entirety.

BACKGROUND OF THE INVENTION

Embodiments according to the invention are related to an apparatus for providing one or more adjusted parameters for a provision of an upmix signal representation on the basis of a downmix signal representation and an object-related parametric information.

Another embodiment according to the invention is related to an audio signal decoder.

Another embodiment according to the invention is related to an audio signal transcoder.

Yet further embodiments according to the invention are related to a method for providing one or more adjusted parameters.

Yet further embodiments are related to a method for providing, as an upmix signal representation, a plurality of upmix audio channels on the basis of a downmix signal representation, an object-related parametric information and a desired rendering information.

Yet another embodiment is related to a method for providing, as an upmix signal representation, a downmix signal representation and a channel-related parametric information on the basis of a downmix signal representation, an object-related parametric information and a desired rendering information.

Yet further embodiments according to the invention are related to an audio signal encoder, a method for providing an encoded audio signal representation and an audio bitstream.

Yet further embodiments are related to corresponding computer programs.

Yet further embodiments according to the invention are related to methods, apparatus and computer programs for distortion avoiding audio signal processing.

In the art of audio processing, audio transmission and audio storage, there is an increasing desire to handle multi-channel contents in order to improve the hearing impression. Usage of multi-channel audio content brings along significant improvements for the user. For example, a 3-dimensional hearing impression can be obtained, which brings along an improved user satisfaction in entertainment applications. However, multi-channel audio contents are also useful in professional environments, for example in telephone conferencing applications, because the speaker intelligibility can be improved by using a multi-channel audio playback.

However, it is also desirable to have a good tradeoff between audio quality and bitrate requirements in order to avoid an excessive resource load caused by multi-channel applications.

Recently, parametric techniques for the bitrate-efficient transmission and/or storage of audio scenes containing multiple audio objects has been proposed, for example, Binaural Cue Coding (Type I) (see, for example reference [BCC]), Joint Source Coding (see, for example, reference [JSC]), and MPEG Spatial Audio Object Coding (SAOC) (see, for example, references [SAOC1], [SAOC2]).

These techniques aim at perceptually reconstructing the desired output audio scene rather than by a waveform match.

FIG. 8 shows a system overview of such a system (here: MPEG SAOC). The MPEG SAOC system 800 shown in FIG. 8 comprises an SAOC encoder 810 and an SAOC decoder 820. The SAOC encoder 810 receives a plurality of object signals $x_1$ to $x_N$, which may be represented, for example, as time-domain signals or as time-frequency-domain signals (for example, in the form of a set of transform coefficients of a Fourier-type transform, or in the form of QMF subband signals). The SAOC encoder 810 typically also receives downmix coefficients $d_1$ to $d_N$, which are associated with the object signals $x_1$ to $x_N$. Separate sets of downmix coefficients may be available for each channel of the downmix signal. The SAOC encoder 810 is typically configured to obtain a channel of the downmix signal by combining the object signals $x_1$ to $x_N$ in accordance with the associated downmix coefficients $d_1$ to $d_N$. Typically, there are less downmix channels than object signals $x_1$ to $x_N$. In order to allow (at least approximately) for a separation (or separate treatment) of the object signals at the side of the SAOC decoder 820, the SAOC encoder 810 provides both the one or more downmix signals (designated as downmix channels) 812 and a side information 814. The side information 814 describes characteristics of the object signals $x_1$ to $x_N$, in order to allow for a decoder-sided object-specific processing.

The SAOC decoder 820 is configured to receive both the one or more downmix signals 812 and the side information 814. Also, the SAOC decoder 820 is typically configured to receive a user interaction information and/or a user control information 822, which describes a desired rendering setup. For example, the user interaction information/user control information 822 may describe a speaker setup and the desired spatial placement of the objects which provide the object signals $x_1$ to $x_N$.

The SAOC decoder 820 is configured to provide, for example, a plurality of decoded upmix channel signals $\hat{y}_1$ to $\hat{y}_M$. The upmix channel signals may for example be associated with individual speakers of a multi-speaker rendering arrangement. The SAOC decoder 820 may, for example, comprise an object separator 820*a*, which is configured to reconstruct, at least approximately, the object signals $x_1$ to $x_N$ on the basis of the one or more downmix signals 812 and the side information 814, thereby obtaining reconstructed object signals 820*b*. However, the reconstructed object signals 820*b* may deviate somewhat from the original object signals $x_1$ to $x_N$, for example, because the side information 814 is not quite sufficient for a perfect reconstruction due to the bitrate constraints. The SAOC decoder 820 may further comprise a mixer 820*c*, which may be configured to receive the reconstructed object signals 820*b* and the user interaction information/user control information 822, and to provide, on the basis thereof, the upmix channel signals $\hat{y}_1$ to $\hat{y}_M$. The mixer 820 may be configured to use the user interaction information/user control information 822 to determine the contribution of the individual reconstructed object signals 820*b* to the upmix channel signals $\hat{y}_1$ to $\hat{y}_M$. The user interaction information/user control information 822 may, for example, comprise rendering parameters (also designated as rendering coefficients), which determine the contribution of the individual reconstructed object signals 822 to the upmix channel signals $\hat{y}_1$ to $\hat{y}_M$.

However, it should be noted that in many embodiments, the object separation, which is indicated by the object separator 820*a* in FIG. 8, and the mixing, which is indicated by the mixer 820*c* in FIG. 8, are performed in single step. For this purpose, overall parameters may be computed which describe a direct mapping of the one or more downmix signals 812 onto the upmix channel signals $\hat{y}_1$ to $\hat{y}_M$. These parameters may be computed on the basis of the side information and the user interaction information/user control information 820.

Taking reference now to FIGS. 9*a*, 9*b* and 9*c*, different apparatus for obtaining an upmix signal representation on the basis of a downmix signal representation and object-related side information will be described. FIG. 9*a* shows a block schematic diagram of a MPEG SAOC system 900 comprising an SAOC decoder 920. The SAOC decoder 920 comprises, as separate functional blocks, an object decoder 922 and a mixer/renderer 926. The object decoder 922 provides a plurality of reconstructed object signals 924 in dependence on the downmix signal representation (for example, in the form of one or more downmix signals represented in the time domain or in the time-frequency-domain) and object-related side information (for example, in the form of object meta data). The mixer/renderer 924 receives the reconstructed object signals 924 associated with a plurality of N objects and provides, on the basis thereof, one or more upmix channel signals 928. In the SAOC decoder 920, the extraction of the object signals 924 is performed separately from the mixing/rendering which allows for a separation of the object decoding functionality from the mixing/rendering functionality but brings along a relatively high computational complexity.

Taking reference now to FIG. 9*b*, another MPEG SAOC system 930 will be briefly discussed, which comprises an SAOC decoder 950. The SAOC decoder 950 provides a plurality of upmix channel signals 958 in dependence on a downmix signal representation (for example, in the form of one or more downmix signals) and an object-related side information (for example, in the form of object meta data). The SAOC decoder 950 comprises a combined object decoder and mixer/renderer, which is configured to obtain the upmix channel signals 958 in a joint mixing process without a separation of the object decoding and the mixing/rendering, wherein the parameters for said joint upmix process are dependent both on the object-related side information and the rendering information. The joint upmix process depends also on the downmix information, which is considered to be part of the object-related side information.

To summarize the above, the provision of the upmix channel signals 928, 958 can be performed in a one step process or a two step process.

Taking reference now to FIG. 9*c*, an MPEG SAOC system 960 will be described. The SAOC system 960 comprises an SAOC to MPEG Surround transcoder 980, rather than an SAOC decoder.

The SAOC to MPEG Surround transcoder comprises a side information transcoder 982, which is configured to receive the object-related side information (for example, in the form of object meta data) and, optionally, information on the one or more downmix signals and the rendering information. The side information transcoder is also configured to provide an MPEG Surround side information (for example, in the form of an MPEG Surround bitstream) on the basis of a received data. Accordingly, the side information transcoder 982 is configured to transform an object-related (parametric) side information, which is relieved from the object encoder, into a channel-related (parametric) side information, taking into consideration the rendering information and, optionally, the information about the content of the one or more downmix signals.

Optionally, the SAOC to MPEG Surround transcoder 980 may be configured to manipulate the one or more downmix signals, described, for example, by the downmix signal representation, to obtain a manipulated downmix signal representation 988. However, the downmix signal manipulator 986 may be omitted, such that the output downmix signal representation 988 of the SAOC to MPEG Surround transcoder 980 is identical to the input downmix signal representation of the SAOC to MPEG Surround transcoder. The downmix signal manipulator 986 may, for example, be used if the channel-related MPEG Surround side information 984 would not allow to provide a desired hearing impression on the basis of the input downmix signal representation of the SAOC to MPEG Surround transcoder 980, which may be the case in some rendering constellations.

Accordingly, the SAOC to MPEG Surround transcoder 980 provides the downmix signal representation 988 and the MPEG Surround bitstream 984 such that a plurality of upmix channel signals, which represent the audio objects in accordance with the rendering information input to the SAOC to MPEG Surround transcoder 980 can be generated using an MPEG Surround decoder which receives the MPEG Surround bitstream 984 and the downmix signal representation 988.

To summarize the above, different concepts for decoding SAOC-encoded audio signals can be used. In some cases, a SAOC decoder is used, which provides upmix channel signals (for example, upmix channel signals 928, 958) in dependence on the downmix signal representation and the object-related parametric side information. Examples for this concept can be seen in FIGS. 9*a* and 9*b*. Alternatively, the SAOC-encoded audio information may be transcoded to obtain a downmix signal representation (for example, a downmix signal representation 988) and a channel-related side information (for example, the channel-related MPEG Surround bitstream 984), which can be used by an MPEG Surround decoder to provide the desired upmix channel signals.

In the MPEG SAOC system 800, a system overview of which is given in FIG. 8, the general processing is carried out in a frequency selective way and can be described as follows within each frequency band:

- N input audio object signals $x_1$ to $x_N$ are downmixed as part of the SAOC encoder processing. For a mono downmix, the downmix coefficients are denoted by $d_1$ to $d_N$. In addition, the SAOC encoder 810 extracts side information 814 describing the characteristics of the input audio objects. For MPEG SAOC, the relations of the object powers with respect to each other are the most basic form of such a side information.
- Downmix signal (or signals) 812 and side information 814 are transmitted and/or stored. To this end, the downmix audio signal may be compressed using well-known perceptual audio coders such as MPEG-1 Layer II or III (also known as ".mp3"), MPEG Advanced Audio Coding (AAC), or any other audio coder.
- On the receiving end, the SAOC decoder 820 conceptually tries to restore the original object signal ("object separation") using the transmitted side information 814 (and, naturally, the one or more downmix signals 812). These approximated object signals (also designated as reconstructed object signals 820*b*) are then mixed into a target scene represented by M audio output channels (which may, for example, be represented by the upmix channel signals $\hat{y}_1$ to $\hat{y}_M$) using a rendering matrix. For a mono output, the rendering matrix coefficients are given by $r_1$ to $r_N$ Effectively, the separation of the object signals is rarely executed (or even never executed), since both the separation step (indicated by the object separator 820*a*) and the mixing step (indicated by the mixer 820*c*) are combined into a single transcoding step, which often results in an enormous reduction in computational complexity.

It has been found that such a scheme is tremendously efficient, both in terms of transmission bitrate (it is only necessitated to transmit a few downmix channels plus some side information instead of N discrete object audio signals or a discrete system) and computational complexity (the processing complexity relates mainly to the number of output channels rather than the number of audio objects). Further advantages for the user on the receiving end include the freedom of choosing a rendering setup of his/her choice (mono, stereo, surround, virtualized headphone playback, and so on) and the feature of user interactivity: the rendering matrix, and thus the output scene, can be set and changed interactively by the user according to will, personal preference or other criteria. For example, it is possible to locate the talkers from one group together in one spatial area to maximize discrimination from other remaining talkers. This interactivity is achieved by providing a decoder user interface:

For each transmitted sound object, its relative level and (for non-mono rendering) spatial position of rendering can be adjusted. This may happen in real-time as the user changes the position of the associated graphical user interface (GUI) sliders (for example: object level=+5 dB, object position=−30 deg).

However, it has been found that the decoder-sided choice of parameters for the provision of the upmix signal representation (e.g. the upmix channel signals $\hat{y}_1$ to $\hat{y}_M$) brings along audible degradations in some cases.

SUMMARY

According to an embodiment, an apparatus for providing one or more adjusted parameters for a provision of an upmix signal representation on the basis of a downmix signal representation and an object-related parametric information, may have: a parameter adjuster configured to receive one or more input parameters and to provide, on the basis thereof, one or more adjusted parameters, wherein the parameter adjuster is configured to provide the one or more adjusted parameters in dependence on the one or more input parameters and the object-related parametric information, such that a distortion of the upmix signal representation caused by the use of non-optimal parameters is reduced at least for input parameters that deviate from optimal parameters by more than a predetermined deviation.

According to another embodiment, an audio signal decoder for providing, as an upmix signal representation, a plurality of upmix audio channels on the basis of a downmix signal representation, an object-related parametric information and a desired rendering information, may have: an upmixer configured to obtain the upmixed audio channels on the basis of the downmix signal representation and in dependence on the object-related parametric information and an actual rendering information describing an allocation of a plurality of object signals of audio objects described by the object-related parametric information to the upmixed audio channels; and an inventive apparatus for providing one or more adjusted parameters, wherein the apparatus for providing one or more adjusted parameters is configured to receive the desired rendering information as the one or more input parameters and to provide the one or more adjusted parameters as the actual rendering information; and wherein the apparatus for providing the one or more adjusted parameters is configured to provide the one or more adjusted parameters such that distortions of the upmixed audio channels caused by the use of the actual rendering parameters, which deviate from optimal rendering parameters, are reduced at least for desired rendering parameters deviating from the optimal rendering parameters by more than a predetermined deviation.

According to another embodiment, an audio signal transcoder for providing, as an upmix signal representation, a channel-related parametric information on the basis of a downmix signal representation, an object-related parametric information and a desired rendering information, may have: a side information transcoder configured to obtain the channel-related parametric information on the basis of the downmix signal representation and in dependence on the object-related parametric information and an actual rendering information describing an allocation of a plurality of object signals of audio objects described by the object-related parametric information to upmix audio channels described by the channel-related parametric information; and an inventive apparatus for providing one or more adjusted parameters, wherein the apparatus for providing one or more adjusted parameters is configured to receive the desired rendering information as the one or more input parameters and to provide the one or more adjusted parameters as the actual rendering information; and wherein the apparatus for providing the one or more adjusted parameters is configured to provide the one or more adjusted parameters such that distortions of the upmixed audio channels caused by the use of the actual rendering parameters, which deviate from optimal rendering parameters, are reduced at least for desired rendering parameters deviating from the optimal rendering parameters by more than a predetermined deviation.

According to another embodiment, a method for providing one or more adjusted parameters for a provision of an upmix signal representation on the basis of a downmix signal representation and an object-related parametric information may have the steps of: receiving one or more input parameters and providing, on the basis thereof, one or more adjusted parameters, wherein the one or more adjusted parameters are provided in dependence on the one or more input parameters and the object-related parametric information, such that a distortion of the upmix signal representation caused by the use of non-optimal parameters is reduced at least for input parameters deviating from optimal parameters by more than a predetermined deviation.

According to another embodiment, a method for providing, as an upmix signal representation, a plurality of upmixed audio channels on the basis of a downmix signal representation, an object related parametric information and a desired rendering information, may have the steps of: the inventive providing of one or more adjusted parameters, wherein the desired rendering information is received as the one or more input parameters and wherein the one or more adjusted parameters are provided as an actual rendering information, and wherein the one or more adjusted parameters are provided such that distortions of the upmixed audio channels caused by the use of the actual rendering parameters, which deviate from optimal rendering parameters, are reduced at least for desired rendering parameters deviating from the optimal rendering parameters by more than a predetermined deviation; and obtaining the upmixed audio channels on the basis of the downmix signal representation and in dependence on the object-related parametric information and the actual rendering information describing an allocation of a plurality of object signals of audio objects described by the object-related parametric information to the upmixed audio channels.

According to another embodiment, a method for providing, as an upmix signal representation, a channel-related parametric information on the basis of a downmix signal representation, an object-related parametric information and a desired rendering information, may have the steps of: the inventive providing of one or more adjusted parameters, wherein the desired rendering information is received as the one or more input parameters and wherein the one or more adjusted parameters are provided as an actual rendering information, and wherein the one or more adjusted parameters are provided such that distortions of the upmixed audio channels caused by the use of the actual rendering parameters, which deviate from optimal rendering parameters, are reduced at least for desired rendering parameters deviating from the optimal rendering parameters by more than a predetermined deviation; and obtaining the channel-related parametric information, which describes the upmixed audio channels, on the basis of the downmix signal representation and in dependence on the object-related parametric information and the actual rendering information describing an allocation of a plurality of object signals of audio objects described by the object-related parametric information to upmixed audio channels, which upmixed audio channels are described by the channel related parametric information.

According to another embodiment, an audio signal encoder for providing a downmix signal representation and an object-related parametric information on the basis of a plurality of object signals may have: a downmixer configured to provide one or more downmix signals in dependence on downmix coefficients associated with the object signals, such that the one or more downmix signals include a superposition of a plurality of object signals; a side information provider configured to provide an inter-object-relationship side information describing level differences and correlation characteristics of object signals and an individual-object side information describing one or more individual properties of the individual object signals.

According to another embodiment, a method for providing a downmix signal representation and an object-related parametric information on the basis of a plurality of object signals may have the steps of: providing one or more downmix signals in dependence on downmix coefficients associated with the object signals, such that the one or more downmix signals include a superposition of a plurality of object signals; and providing an inter-object-relationship side information describing level differences and correlation characteristics of object signals; and providing an individual-object side information describing one or more individual properties of the individual object signals.

According to an embodiment, an audio bitstream representing a plurality of object signals in an encoded form may have: a downmix signal representation representing one or more downmix signals, wherein at least one of the downmix signals includes a superposition of a plurality of object signals; and an inter-object-relationship side information describing level differences and correlation characteristics of object signals; and an individual-object side information describing one or more individual properties of the individual object signals.

Another embodiment may have a computer program for performing one of the inventive methods.

An embodiment according to the invention creates an apparatus for providing one or more adjusted parameters for a provision of an upmix signal representation on the basis of a downmix signal representation and an object-related parametric information. The apparatus comprises a parameter adjuster (for example, a rendering coefficient adjuster) configured to receive one or more input parameters (for example, a rendering coefficient or a description of a desired rendering matrix) and to provide, on the basis thereof, one or more adjusted parameters. The parameter adjuster is configured to provide the one or more adjusted parameters in dependence of the one or more input parameters and the object-related parametric information (for example, in dependence on one or more downmix coefficients, and/or one or more object-level-difference values, and/or one or more inter-, object-correlation values), such that a distortion of the upmix signal representation, which would be caused by the use of non-optimal parameters, is reduced at least for input parameters deviating from optimal parameters by more than a predetermined deviation.

This embodiment according to the invention is based on the idea that audio signal distortions which are caused by inappropriately chosen input parameters can be reduced by providing adjusted parameters for the provision of the upmix signal representation, and that the provision of the adjusted parameters can be performed with good accuracy by taking into consideration the object-related parametric information. It has been found that the usage of the object-related parametric information allows to obtain an estimate measure of audible distortions, which would be caused by the usage of the input parameters, which in turn allows to provide adjusted parameters which are suited to keep audible distortions within a predetermined range or which are suited to reduce audible distortions when compared to the input parameters. The object-related information describes, for example, characteristics of the audio objects and/or gives information about the encoder-sided processing of the objects.

Accordingly, undesirable and often annoying audio signal distortions, which would be caused by the usage of inappropriate parameters (for example, inappropriate rendering coefficients) can be reduced, or even avoided, by providing one or more adjusted parameters, wherein the consideration of the object-related parametric information for the adjustment of the parameters helps to ensure an effective reduction and/or limitation of audio signal distortions by allowing for a comparatively reliable estimation of audible distortions.

In an embodiment, the apparatus is configured to receive, as the input parameters, desired rendering parameters describing a desired intensity scaling of a plurality of audio object signals in one or more channels described by the upmix signal representation. In this case, the parameter adjuster is configured to provide one or more actual rendering parameters in dependence on the one or more desired rendering parameters. It has been found that the choice of inappropriate rendering parameters brings along a significant (and often audible) degradation of an upmix signal representation, which is obtained using such inappropriately chosen rendering parameters. Also, it has been found that the rendering parameters can efficiently be adjusted in dependence on the object-related parametric information, because the object-related parametric information allows for an estimation of distortions, which would be introduced by a given choice of the rendering parameters (which may be defined by the input parameters).

In an embodiment, the parameter adjuster is configured to obtain one or more rendering parameter limit values in dependence on the object-related parametric information and a downmix information describing a contribution of the audio object signals to the downmix signal representation, such that a distortion metric is within a predetermined range for rendering parameter values obeying limits defined by the rendering parameter limit values. In this case, the parameter adjuster is configured to obtain the actual rendering parameters in dependence on the desired rendering parameters and the one or more rendering parameter limit values, such that the actual rendering parameters obey the limits defined by the rendering parameter limit values. Computing rendering parameter limit values constitutes a computationally simple and reliable mechanism for ensuring that audible distortions are within an allowable range in accordance with a distortion metric.

In an embodiment, the parameter adjuster is configured to obtain the one or more rendering parameter limit values such that a relative contribution of an object signal in a rendered superposition of a plurality of object signals, rendered using a rendering parameter obeying the one or more rendering parameter limit values, differs from a relative contribution of the object signal in a downmix signal by no more than a predetermined difference. It has been found that distortions are typically sufficiently small, if the contribution of an object signal in a rendered superposition of object signals is similar to a contribution of the object signal in a downmix signal, while a strong difference of said relative contributions typically brings along audible distortions. This is due to the fact that a strong change of the (relative) level of an object signal when compared to the (relative) level of the object signal in the downmix signal representation often brings along artifacts, because often it is not possible to separate object signals of different audio objects in the ideal way. Accordingly, it has been found to bring along good results to adjust the rendering parameters such that the relative contribution of the object signals is only changed moderately by the choice of the rendering parameters.

In another embodiment, the parameter adjuster is configured to obtain the one or more rendering parameter limit values such that a distortion measure which describes a coherence between a downmix signal described by the downmix signal representation and a rendered signal, rendered using the one or more rendering parameters obeying the one or more rendering parameter limit values, is within a predetermined range. It has been found that the choice of desired rendering parameters, which form the input parameters of the parameter adjuster, should be made such that a sufficient "similarity" is maintained between the downmix signal described by the downmix signal representation and the rendered signal, because otherwise the risk of obtaining audible artifacts in the upmix process is quite high.

In yet another embodiment, the parameter adjuster is configured to compute a linear combination between a square of a desired rendering parameter (which may form the input parameter of the parameter adjuster) and a square of an optimal rendering parameter (which may, for example, be defined as a rendering parameter minimizing a distortion metric), to obtain the actual rendering parameter (which may be output by the apparatus as the adjusted parameter). In this case, the parameter adjuster is configured to determine a contribution of the desired rendering parameter and of the optimal rendering parameter to the linear combination in dependence on a predetermined threshold parameter T and distortion metric, wherein the distortion metric describes a distortion which would be caused by using the one or more desired rendering parameters, rather than the optimal rendering parameters, for obtaining the upmix signal representation on the basis of the downmix signal representation. This concept allows for reducing the distortion to an acceptable measure while still maintaining a sufficient impact of the desired rendering parameters. According to this concept, a reasonably good compromise between the optimal rendering parameters and the desired rendering parameters can be found, taking into account a desired degree of limiting the audible distortions.

In an embodiment, the parameter adjuster is configured to provide one or more adjusted parameters in dependence on a computational measure of perceptual degradation, such that a perceptually evaluated distortion of the upmix signal representation caused by the use of non-optimal parameters and represented by the computational measure of perceptual degradation is limited. In this way, it can be achieved that the parameters are adjusted in accordance with the hearing impression, thereby avoiding an unacceptably bad hearing impression while still providing sufficient flexibility in adjusting the parameters in accordance with a user's desires.

In an embodiment, the parameter adjuster is configured to receive an object property information describing properties of one or more original object signals, which form the basis for a downmix signal described by the downmix signal representation. In this case, the parameter adjuster is configured to consider the object property information to provide the adjusted parameters such that a distortion of the upmix signal representation with respect to properties of object signals included in the upmix signal representation is reduced at least for input parameters deviating from optimal parameters by more than a predetermined deviation. This embodiment according to the invention is based on the finding that the properties of the one or more original object signals may be used to evaluate whether the input parameters are appropriate or should be adjusted, because it is desirable to provide the upmix signal such that the characteristics of the upmix signal are related to the properties of the one or more original object signals, because otherwise the perceptual impression would be significantly degraded in many cases.

In an embodiment, the parameter adjuster is configured to receive and consider, as an object property information, an object signal tonality information, in order to provide the one or more adjusted parameters. It has been found that the tonality of the object signals is a quantity which has a significant impact on the perceptual impression, and that the choice of parameters which significantly change the tonality impression should be avoided in order to have a good hearing impression.

In an embodiment, the parameter adjuster is configured to estimate a tonality of an ideally-rendered upmix signal in dependence on the received object signal tonality information and a received object power information. In this case, the parameter adjuster is configured to provide the one or more adjusted parameters to reduce the difference between the estimated tonality and the tonality of an upmix signal obtained using the one or more adjusted parameters when compared to a difference between the estimated tonality and a tonality of an upmix signal obtained using the input parameters, or to keep a difference between the estimated tonality and a tonality of an upmixed signal obtained using the one or more adjusted parameters within a predetermined range. Using this concept, a measure for a degradation of a hearing impression can be obtained with high computational efficiency, which allows for an appropriate adjustment of the rendering parameters.

In an embodiment, the parameter adjuster is configured to perform a time-and-frequency-variant adjustment of the input parameters. Accordingly, the adjustment of the input parameters, to obtain adjusted parameters, may be performed only for such time intervals or frequency regions for which the adjustment actually brings along an improvement of the hearing impression or avoids a significant degradation of the hearing impression.

Yet in another embodiment, the parameter adjuster is configured to also consider the downmix signal representation for providing the one or more adjusted parameters. By taking into consideration the downmix signal representation, an even more precise estimate of the possible distortion of the hearing impression can be obtained.

In an embodiment, the parameter adjuster is configured to obtain an overall distortion measure, that is a combination of distortion measures describing a plurality of types of artifacts. In this case, the parameter adjuster is configured to obtain the overall distortion measure such that the overall distortion measure is a measure of distortions which would be caused by using one or more of the input rendering parameters rather than optimal rendering parameters for obtaining the upmix signal representation on the basis of the downmix signal representation. By combining a plurality of distortion measures describing a plurality of types of artifacts, a well-controlled mechanism for adjusting the hearing impression is created.

Another embodiment according to the invention creates an audio signal decoder for providing, as an upmix signal representation, a plurality of upmixed audio channels on the basis of a downmix signal representation, an object-related parametric information and a desired rendering information. The audio signal decoder comprises an upmixer configured to obtain the upmixed audio channels on the basis of the downmix signal representation and in dependence on the object-related parametric information and an actual rendering information describing an allocation of a plurality of object signals of audio objects described by the object-related parametric information to the upmixed audio channels. The audio signal decoder also comprises an apparatus for providing one or more adjusted parameters, as discussed before. The apparatus for providing one or more adjusted parameters is configured to receive the desired rendering information as the one or more input parameters and to provide the one or more adjusted parameters as the actual rendering information. The apparatus for providing the one or more adjusted parameters is also configured to provide the one or more adjusted parameters such that distortions of the upmixed audio channels caused by the use of the actual rendering parameters, which deviate from optimal rendering parameters, are reduced at least for desired rendering parameters deviating from the optimal rendering parameters by more than a predetermined deviation.

The usage of the apparatus for providing the one or more adjusted parameters in an audio signal decoder allows to avoid a generation of strong audible distortions, which would be caused by performing the audio decoding with inappropriately-chosen desired rendering information.

An embodiment according to the invention creates an audio signal transcoder for providing, as an upmix signal representation, a channel-related parameter information, on the basis of a downmix signal representation, an object-related parametric information and a desired rendering information. The audio signal transcoder comprises a side information transcoder configured to obtain the channel-related parametric information on the basis of the downmix signal representation and in dependence on the object-related parametric information and an actual rendering information describing an allocation of a plurality of object signals of audio objects described by the object-related parametric information to the upmix audio channels. The audio signal decoder also comprises an apparatus for providing one or more adjusted parameters, as described above. The apparatus for providing one or more adjusted parameters is configured to receive the desired rendering information as the one or more input parameters and to provide the one or more adjusted parameters as the actual rendering information. Also, the apparatus for providing the one or more adjusted parameters is configured to provide the one or more adjusted parameters such that distortions of upmixed audio channels represented by the channel-related parametric information (in combination with downmix signal information), which are caused by the use of the actual rendering parameters, which deviate from optimal rendering parameters, are reduced at least for desired rendering parameters deviating from the optimal rendering parameters by more than a predetermined deviation. It has been found that the concept of providing adjusted parameters is also well-suited for the use in combination with an audio signal transcoder.

Further embodiments according to the invention create a method for providing one or more adjusted parameters, a method for decoding an audio signal and a method for transcoding an audio signal. Said methods are based on the same key ideas as the above discussed apparatus.

Another embodiment according to the invention creates an audio signal encoder for providing a downmix signal representation and an object-related parametric information on the basis of a plurality of object signals. The audio encoder comprises a downmixer configured to provide one or more downmix signals in dependence on downmix coefficients associated with the object signals, such that the one or more downmix signals comprise a superposition of a plurality of object signals. The audio encoder also comprises a side information provider configured to provide an inter-object-relationship side information describing level differences and correlation characteristics of object signals and an individual-object side information describing one or more individual properties of the individual object signals. It has been found that the provision of both an inter-object-relationship side information and an individual-object side information by an audio signal encoder allows to efficiently reduce, or even avoid, audible distortions at the side of a multi-channel audio signal decoder. While the inter-object-relationship side information is used for separating the object signals at the decoder side, the individual-object side information can be used to determine whether the individual characteristics of the object signals are maintained at the decoder side, which indicates that the distortions are within acceptable tolerances.

In an embodiment, the side information provider is configured to provide the individual-object side information such that the individual-object side information describes tonalities of the individual objects. It has been found that the tonality of the individual objects is a psycho-acoustically important quantity, which allows for a decoder-sided limitation of distortions.

Another embodiment according to the invention creates a method for encoding an audio signal.

Another embodiment according to the invention creates an audio bitstream representing a plurality of (audio) object signals in an encoded form. The audio bitstream comprises a downmix signal representation representing one or more downmix signals, wherein at least one of the downmix signals comprises a superposition of a plurality of (audio) object signals. The audio bitstream also comprises an inter-object-relationship side information describing level differences and correlation characteristics of object signals and an individual-object side information describing one or more individual properties of the individual object signals. As discussed above, such an audio bitstream allows for a reconstruction of the multi-channel audio signal, wherein audible distortions, which would be caused by inappropriate setting of rendering parameters, can be recognized and reduced or even eliminated.

Further embodiments according to the invention create a computer program for implementing the above discussed methods.

BRIEF DESCRIPTION OF THE DRAWINGS

Embodiments of the present invention will be detailed subsequently referring to the appended drawings, in which.

DETAILED DESCRIPTION OF THE INVENTION

1. Apparatus for Providing One or More Adjusted Parameters, According to FIG. 1

Figure 1:
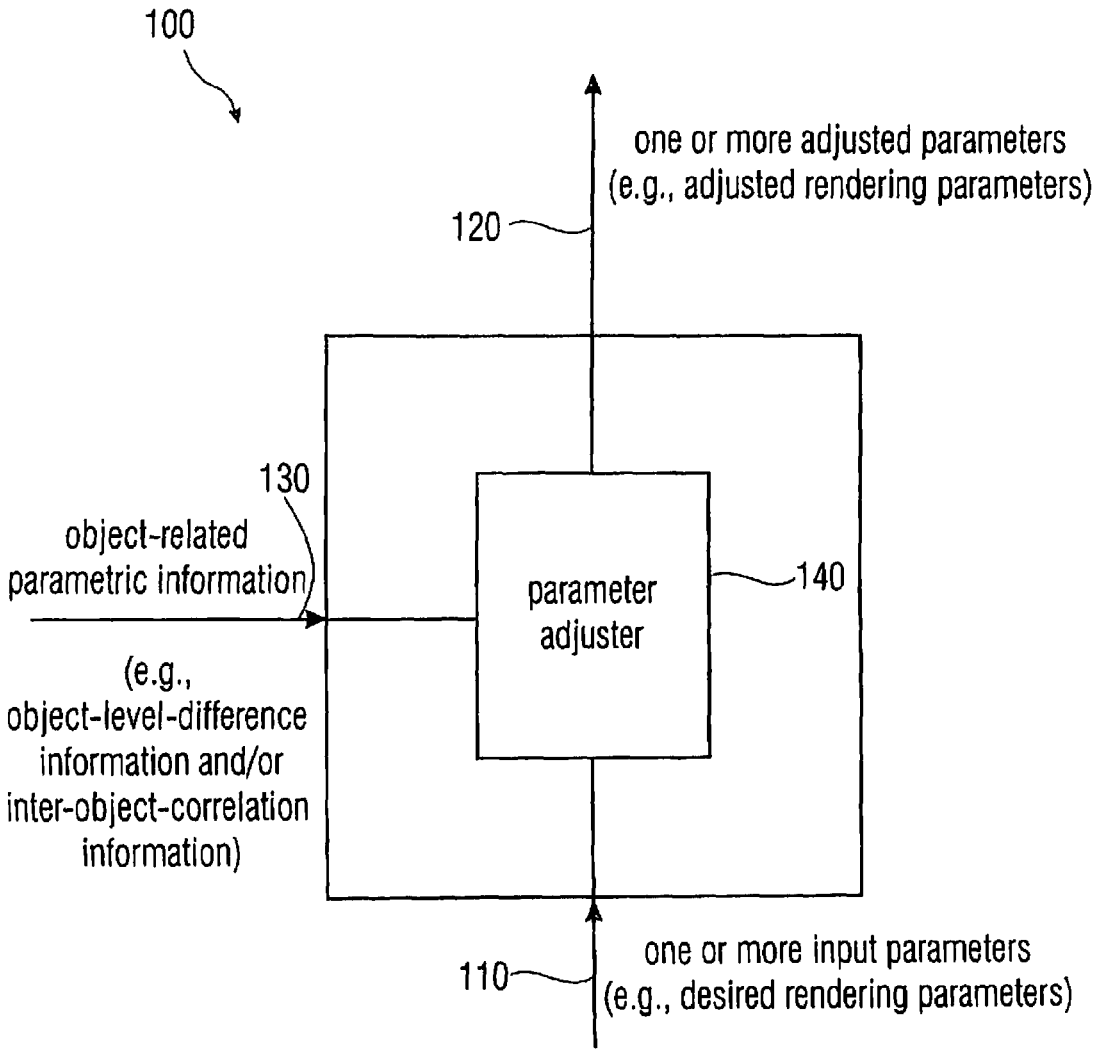
FIG. 1 shows a block schematic diagram of an apparatus for providing one or more adjusted parameters for a provision of an upmix signal representation on the basis of a downmix signal representation and an object-related parametric information.

In the following, an apparatus 100 for providing one or more adjusted parameters for a provision of an upmix signal representation on the basis of a downmix signal representation and an object-related parametric information will be described taking reference to FIG. 1. FIG. 1 shows a block schematic diagram of such an apparatus 100, which is configured to receive one or more input parameters 110. The input parameters 110 may, for example, be desired rendering parameters. The apparatus 100 is also configured to provide, on the basis thereof, one or more adjusted parameters 120. The adjusted parameters may, for example, be adjusted rendering parameters. The apparatus 100 is further configured to receive an object-related parametric information 130. The object-related parametric information 130 may, for example, be an object-level-difference information and/or an inter-object correlation information describing a plurality of objects. The apparatus 100 comprises a parameter adjuster 140, which is configured to receive the one or more input parameters 110 and to provide, on the basis thereof, the one or more adjusted parameters 120. The parameter adjuster 140 is configured to provide the one or more adjusted parameters 120 in dependence on the one or more input parameters 110 and the object-related parametric information 130, such that a distortion of an upmix signal representation, which would be caused by the use of non-optimal parameters (e.g. the one or more input parameters 110) in an apparatus for providing an upmix signal representation on the basis of a downmix signal representation and the object-related parametric information 130, is reduced at least for input parameters 110 deviating from optimal parameters by more than a predetermined deviation.

Accordingly, the apparatus 100 receives the one or more input parameters 110 and provides, on the basis thereof, the one or more adjusted parameters 120. In providing the one or more adjusted parameters 120, the apparatus 100 determines, explicitly or implicitely, whether the unchanged use of the one or more input parameters 110 would cause unacceptably high distortions if the one or more input parameters 110 were used for controlling a provision of an upmix signal representation on the basis of a downmix signal representation and the object-related parametric information 130. Thus, the adjusted parameters 120 are typically better-suited for adjusting such an apparatus for the provision of the upmix signal representation than the one or more input parameters 110, at least if the one or more input parameters 110 are chosen in an inadvantageous way.

Accordingly, the apparatus 100 typically improves the perceptual impression of an upmix signal representation, which is provided by an upmix signal representation provider in dependence on the one or more adjusted parameters 120. Usage of the object-related parametric information for the adjustment of the one or more input parameters, to derive the one or more adjusted parameters, has been found to bring along good results, because the quality of the upmix signal representation is typically good if the one or more adjusted parameters 120 correspond to the object-related parametric information 130, while parameters which violate the desired relationship to the object-related parametric information 130 typically result in audible distortions. The object-related parametric information may, for example, comprise downmix parameters, which describe a contribution of object signals (from a plurality of audio objects) to the one or more downmix signals. The object-related parametric information may also comprise, alternatively or in addition, object-level-difference parameters and/or inter-object-correlation parameters, which describe characteristics of the object signals. It has been found that both parameters describing an encoder-sided processing of the object signals and parameters describing characteristics of the audio objects themselves may be considered as useful information for use by the parameter adjuster 120. However, other object-related parametric information 130 may be used by the apparatus 100 alternatively or in addition.

However, it should be noted that the parameter adjuster 140 may use additional information in order to provide the one or more adjusted parameters 120 on the basis of the one or more input parameters 110. For example, the parameter adjuster 140 may optionally evaluate downmix coefficients, one or more downmix signals or any additional information to even improve the provision of the one or more adjusted parameters 120.

2. System According to FIG. 2

In the following, the MPEG SAOC system 200 of FIG. 2 will be described in detail.

In order to provide a good understanding of the MPEG SAOC system 200, an overview will be given of the desired system specifications and design considerations. Subsequently, a structural overview of the system will be given. Moreover, a plurality of SAOC distortion metrics will be discussed, and the application of these SAOC distortion metrics for a limitation of distortions will be described. In addition, further extensions of the system 200 will be discussed.

2.1 System Design Considerations

As discussed above, parametric techniques for the bitrate-efficient transmission/storage of audio scenes containing multiple audio objects are typically efficient, both in terms of transmission bitrate and computational complexity. Further advantages for the user of such system on the receiving end include the freedom of choosing a rendering setup of his/her choice (mono, stereo, surround, virtualized headphone playback, and so on) and the feature of user interactivity: the rendering matrix, and thus the output scene, can be set and changed interactively according to will, personal preference, or other criteria. For example, it is possible to locate talkers from one group together in one spatial area to maximize discrimination from other remaining talkers. This interactivity is achieved by providing a decoder user interface:

For each transmitted sound object, its relative level and (for non-mono rendering) spatial position of rendering can be adjusted. This may happen in real-time as the user changes the position of the associated graphical user interface (GUI) sliders (for example: object level=+5 dB, object position=−30 deg). However, it has been found that due to the downmix separation/mix-based parametric approach, the subjective quality of the rendered audio output depends on the rendering parameter settings. It was found that changes in relative object level affect the final audio quality more than changes in spatial rendering position ("re-panning"). It has also been found that extreme settings for relative parameters (for example, +20 dB) can even lead to unacceptable output quality. While this is simply a result of violating some of the perceptual assumptions that are underlying this scheme, it is still unacceptable for a commercial product to produce bad sound and artifacts depending on the settings on the user interface. Accordingly, embodiments according to the invention, like, for example, the system 200, address this problem of avoiding unacceptable degradations regardless of the settings of the user interface (which settings of the user interface may be considered as "input parameters").

In the following, some details regarding the approaches for avoiding SAOC distortions will be discussed. The approach for SAOC distortion limiting presented herein is based on the following concepts:

- Prominent SAOC distortions appear for inappropriate choices of rendering coefficients (which may be considered as input parameters). This choice is usually made by the user in an interactive manner (for example, via a real-time graphical user interface (GUI) for interactive applications). Therefore, an additional processing step is introduced which modifies the rendering coefficients that were supplied by the user (for example, limits them based on certain calculations) and uses these modified coefficients for the SAOC rendering engine. For example, the rendering coefficients that were supplied by the user may be considered as input parameters, and the modified coefficients for the SAOC rendering engine may be considered as modified parameters.
- In order to control the excessive degradation of the produced SAOC audio output, it is desirable to develop a computational measure of perceptual degradation (also designated as distortion measure DM). It has been found that this distortion measure should fulfill certain criteria:
  - The distortion measure should be easily computable from internal parameters of the SAOC decoding engine. For example, it is desirable that no extra filterbank computation is necessitated to obtain the distortion measure.
  - The distortion measure value should correlate with subjectively perceived sound quality (perceptual degradation), i.e. be inline with the basics of psychoacoustics. To this end, the computation of the distortion measure may be done in a frequency selective way, as it is commonly known from perceptual audio coding and processing.

It has been found that a multitude of SAOC distortion measures can be defined and calculated. However, it has been found that the SAOC distortion measures should consider certain basic factors in order to come to a correct assessment of a rendered SAOC quality and thus often (but not necessarily) have certain commonalities:

- They consider the downmix coefficients. These determine the relative mixing fractions of each audio object within the one or more downmix signals. As a background information, it should be noted that it has been found that the occurring SAOC distortion depends on the relation between downmix and rendering coefficients: if the relative object contribution defined by the rendering coefficients is substantially different from the relative object contribution within the downmix, then the SAOC decoding engine (which uses the modified parameters) has to perform considerable adjustment of the downmix signal to convert it into the rendered output. It has been found that this results in SAOC distortion.
- They consider the rendering coefficients. These determine the relative output strength of each audio object to each of the one or more rendered output signals. As a background information, it should be noted that it has been found that the occurring SAOC distortion also depends on the relation of object powers with respect to each other. If an object at a certain point in time has a much higher power than other objects (and if the downmix coefficient of this object is not too small) then this object dominates the downmix and is reproduced very well in the rendered output signal. On the contrary, weak objects are represented only very weakly in the downmix and thus cannot be brought up to high output levels without significant distortions.
- They consider the (relative) object power/level of each object in relation to the other. This information is described, for example, as SAOC object level differences (OLDs). As a background information, it should be noted that it has been found that the occurring SAOC distortion furthermore depends on the properties of the individual object signals. As an example, boosting an object of a tonal nature in the rendered output to greater levels (whereas the other objects may be more of more noise-like nature) will result in considerable perceived distortion.
- In addition to this, other information about properties of the original object signals can be considered. These may then be transmitted by the SAOC encoder as part of the SAOC side information. For example, information about the tonality or the noisiness of each object item can be transmitted as part of the SAOC side information and be used for the purpose of distortion limiting.

2.2 System Overview

Figure 8:
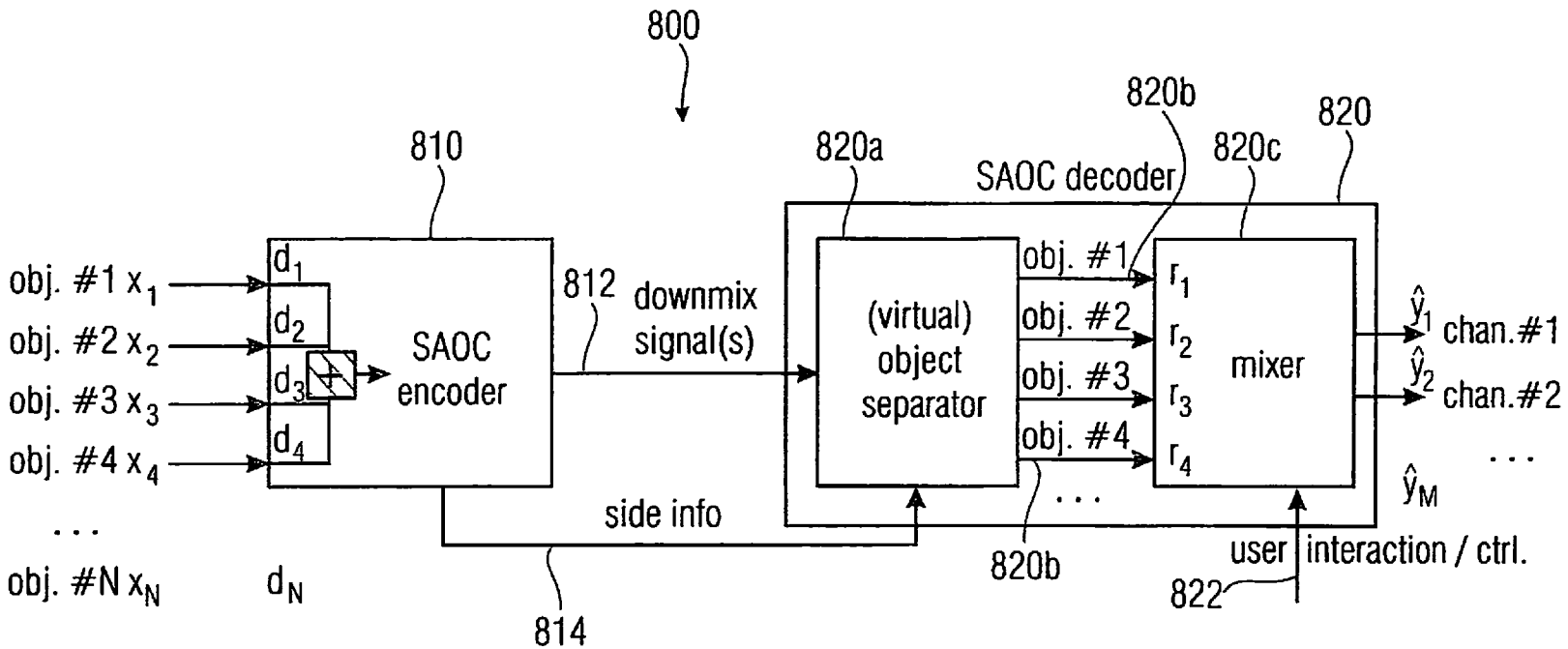
FIG. 8 shows a block schematic diagram of a reference MPEG SAOC system.

Based on the above considerations, an overview over the MPEG SAOC system 200 will be given now for a good understanding of the present invention. It should be noted that the SAOC system 200 according to FIG. 2 is an extended version of the MPEG SAOC system 800 according to FIG. 8, such that the above-discussion also applies. Moreover, it should be noted that the MPEG SAOC system 200 can be modified in accordance with the implementation alternatives 900, 930, 960 shown in FIGS. 9*a*, 9*b* and 9*c*, wherein the object encoder corresponds to the SAOC encoder, wherein the user interaction information/user control information 822 corresponds to the rendering control information/rendering coefficient.

Furthermore, the SAOC decoder of the MPEG SAOC system 100 may be replaced by the separated object decoder and mixer/renderer arrangement 920, by the integrated object decoder and mixer/renderer arrangement 930 or the SAOC to MPEG Surround transcoder 980.

Figure 2:
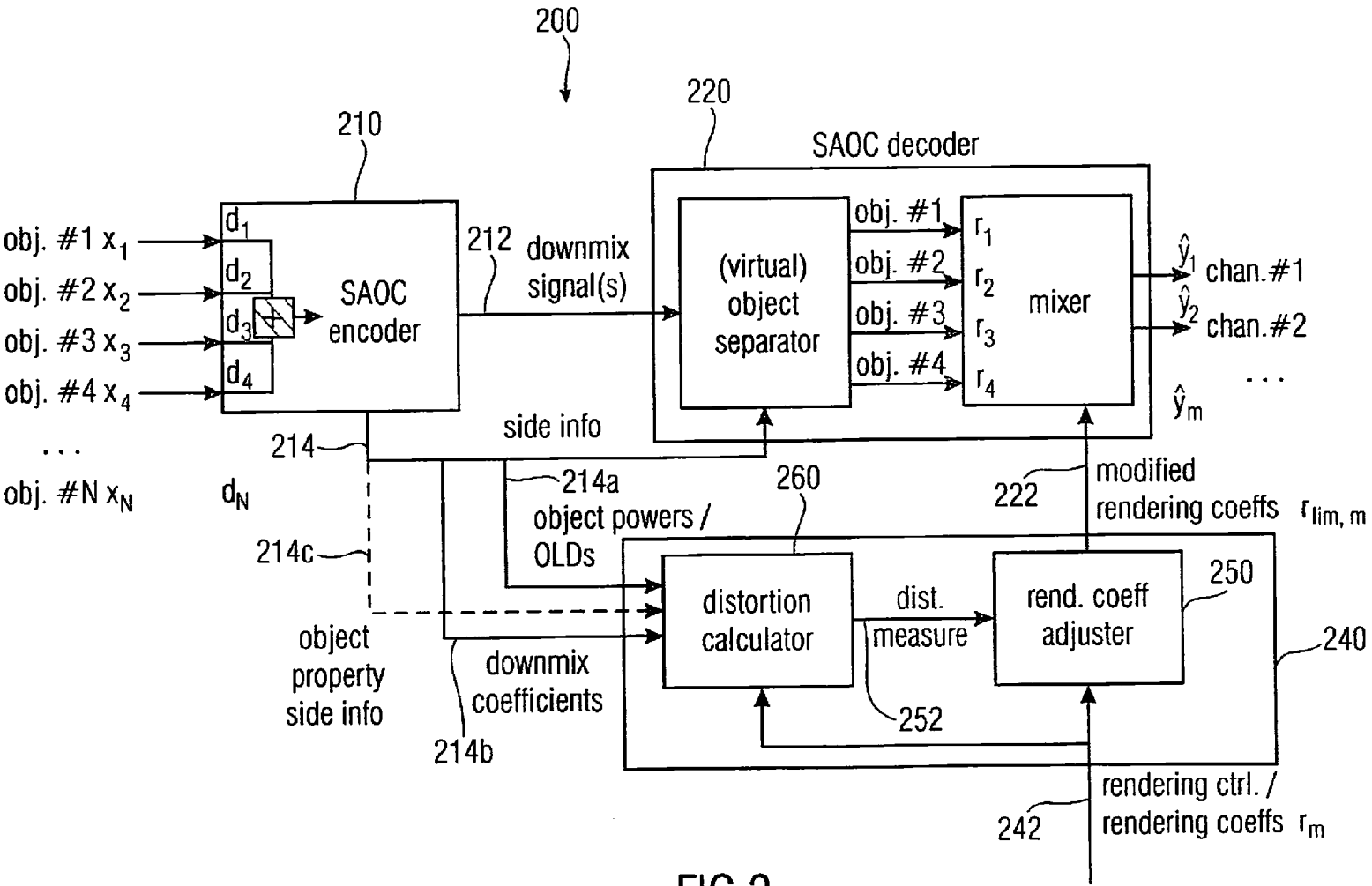
FIG. 2 shows a block schematic diagram of an MPEG SAOC system, according to an embodiment of the invention.

Taking reference now to FIG. 2, it can be seen that the MPEG SAOC system 200 comprises an SAOC encoder 210, which is configured to receive plurality of object signals $x_1$ to $x_N$, associated with a plurality of objects numbered from 1 to N. The SAOC encoder 210 is also configured to receive (or otherwise obtain) downmix coefficients $d_1$ to $d_N$. For example, the SAOC encoder 210 may obtain one set of downmix coefficients $d_1$ to $d_N$ for each channel of the downmix signal 212 provided by the SAOC encoder 210. The SAOC encoder 210 may, for example, be configured to obtain a weighted combination of the object signals $x_1$ to $x_N$ to obtain a downmix signal, wherein each of the object signals $x_1$ to $x_N$ is weighted with its associated downmix coefficient $d_1$ to $d_N$. The SAOC encoder 210 is also configured to obtain inter-object relationship information, which describes a relationship between the different object signals. For example, the inter-object relationship information may comprise object-level-difference information, for example, in the form of OLD parameters and inter-object-correlation information, for example, in form of IOC parameters. Accordingly, the SAOC encoder 200 then is configured to provide one or more downmix signals 212, each of which comprises a weighted combination of one or more object signals, weighted in accordance with a set of downmix parameters associated to the respective downmix signal (or a channel of the multi-channel downmix signal 212). The SAOC encoder 210 is also configured to provide side information 214, wherein the side information 214 comprises the inter-object-relationship-information (for example, in the form of object-level-difference parameters and inter-object-correlation parameters). The side information 214 also comprises a downmix parameter information, for example, in the form of downmix gain parameters and downmix channel level difference parameters. The side information 214 may further comprise an optional object property side information, which may represent individual object properties. Details regarding the optional object property side information will be discussed below.

The MPEG SAOC system 200 also comprises an SAOC decoder 220, which may comprise the functionality of the SAOC decoder 820. Accordingly, the SAOC decoder 220 receives the one or more downmix signals 212 and side information 214, as well as modified (or "adjusted", or "actual") rendering coefficients 222 and provides, on the basis thereof, one or more upmix channel signals $\hat{y}_1$ to $\hat{y}_N$.

The MPEG SAOC system 200 also comprises an apparatus 240 for providing one or more modified (or adjusted, or "actual") parameters, namely the modified rendering coefficients 222, in dependence on one or more input parameters, namely input parameters describing a rendering control information or rendering coefficients 242. The apparatus 240 is configured to also receive at least a part of the side information 214. For example, the apparatus 240 is configured to receive parameters 214*a* describing object powers (for example, powers of the object signals $x_1$ to $x_N$). For example, the parameters 214*a* may comprise the object-level-difference parameters (also designated as OLDs). The apparatus 240 also receives parameters 214*b* of the side information 214 describing downmix coefficients. For example, the parameters 214*b* describe the downmix coefficients $d_1$ to $d_N$. Optionally, the apparatus 240 may further receive additional parameters 214*c*, which constitute an individual-object property side information.

The apparatus 240 is generally configured to provide the modified rendering coefficients 222 on the basis of the input rendering coefficients 242 (which may, for example, be received from a user interface, or may, for example, be computed in dependence on the user input or be provided as preset information), such that a distortion of the upmix signal representation, which would be caused by the use of non-optimal rendering parameters by the SAOC decoder 220, is reduced. In other words, the modified rendering coefficients 222 are a modified version of the input rendering coefficients 242, wherein the changes are made, in dependence on the parameters 214*a*, 214*b*, such that all audible distortions in the upmix channel signals $\hat{y}_1$ to $\hat{y}_N$ (which form the upmix signal representation) are reduced or limited.

The apparatus 240 for providing the one or more adjusted parameters 242 may, for example, comprise a rendering coefficient adjuster 250, which receives the input rendering coefficients 242 and provides, on the basis thereof the modified rendering coefficients 222. For this purpose, the rendering coefficient adjuster 250 may receive a distortion measure 252 which describes distortions which would be caused by the usage of the input rendering coefficients 242. The distortion measure 252 may, for example, be provided by distortion calculator 260 in dependence on the parameters 214*a*, 214*b* and the input rendering coefficients 242.

However, the functionalities of the rendering coefficient adjuster 250 and of the distortion calculator 260 may also be integrated in a single functional unit, such that the modified rendering coefficients 222 are provided without an explicit computation of a distortion measure 252. Rather, implicit mechanisms for reducing or limiting the distortion measure may be applied.

Regarding the functionality of the MPEG SAOC system 200, it should be noted that the upmix signal representation, which is output in the form of the upmix channel signals $\hat{y}_1$ to $\hat{y}_N$, is created with good perceptual quality because audible distortions, which would be caused by an inappropriate choice of the user interaction information/user control information 822 in the reference system 800, are avoided by the modification or adjustment of the rendering coefficients. The modification or adjustment is performed by the apparatus 240 such that severe degradations of the perceptual impression are avoided, or such that degradations of the perceptual impression are at least reduced when compared to a case in which the input rendering coefficients 242 are used directly (without modification or adjustment) by the SAOC decoder 220.

In the following, the functionality of the inventive concept will be briefly summarized. Given a distortion measure (DM), excessive distortion in the audio output can be avoided by calculating the distortion measure value for the given signals, and modifying the SAOC decoding algorithm (limiting the actually used rendering coefficients 212) such that the distortion measure value does not exceed a certain threshold. A system 200 according to this concept is shown in FIG. 2 and has been explained in some detail above.

Regarding the system 200, the following remarks can be made:

- The desired rendering coefficients 242 are input by the user or another interface.
- Before being applied in the SAOC decoding engine 220, the rendering coefficients 242 are modified by a rendering coefficient adjuster 250, which makes use of one or more calculated distortion measures 252, which are supplied from a distortion calculator 260.
- The distortion calculator 260 evaluates information (e.g. parameters 214*a*, 214*b*) from the side information 214 (for example, relative object power/OLDs, downmix coefficients, and—optionally—object-signal property information). Additionally, it is based on the desired rendering coefficient input 242.

In an embodiment, the apparatus 240 is configured to modify the rendering coefficients based on a distortion measure. The rendering coefficients are adjusted in a frequency-selective manner using, for example, frequency-selective weight.

The modification of the rendering coefficients may be based on this frame (for example, on a current frame), or the rendering coefficients may be adjusted over time not just on a frame-by-frame basis, but also processed/controlled over time (for example, smoothened over time) wherein possibly different attack/decay time constants may be applied like for a dynamic range compressor/limiter.

In some embodiments, the distortion measure may be frequency-selective.

In some embodiments, the distortion measure may consider one or more of the following characteristics:

- Power/energy/level of each object;
- Downmix coefficients;
- Rendering coefficients; and/or
- Additional object property side information, if applicable.

In some embodiments, the distortion measure may be calculated per object and combined to arrive at an overall distortion.

In some embodiments, an additional object property side information 214*c* may optionally be evaluated. The additional object property side information 214*c* may be extracted in an enhanced SAOC encoder, for example, in the SAOC encoder 210. The additional object property side information may be embedded, for example, into an enhanced SAOC bitstream, which will be described with reference to FIG. 7. Also, the additional object property side information may be used for distortion limiting by an enhanced SAOC decoder.

In a special case, the noisiness/tonality may be used as the object property described by the additional object property side information. In this case, the noisiness/tonality may be transmitted with a much coarser frequency resolution than other object parameters (for example, OLDs) to save on side information. In an extreme case, the noisiness/tonality object property side information may be transmitted with just one information per object (for example, as broadband characteristics).

2.3 SAOC Distortion Metrics

In the following, a plurality of different distortion measures will be described, which may, for example, be obtained using the distortion calculator 260. Details regarding the application of these distortion measures for the limitation of the rendering coefficients will be discussed below in section 2.4.

In other words, this section outlines several distortion measures. These can be used individually or can be combined to form a compound, more complex distortion metric, for example, by weighted addition of the individual distortion metric values. It should be noted here that the terms "distortion measure" and "distortion metric" designate similar quantities and do not need to be distinguished in most cases.

In the following, a plurality of distortion metrics will be described, which may be evaluated by the distortion calculator 260 and which may be used by the rendering coefficient adjuster 250 in order to obtain the modified rendering coefficients 222 on the basis of the input rendering coefficients 242.

2.3.1 Distortion Measure #1

In the following, a first distortion measure (also designated to the distortion measure #.1) will be described.

For the sake of conceptual simplicity, a N-1-1 SAOC system (e.g., a mono downmix signal (212) and a single upmix channel (signal)) will be considered. N input audio objects are downmixed into a mono signal and rendered into a mono output. As given in FIG. 8, the downmix coefficients are denoted by $d_1 \ldots d_N$ and the rendering coefficients are denoted by $r_1 \ldots r_N$. In the following formulae, time indices have been omitted for simplicity. Likewise, frequency indices have been left out, noting that the equations relate to subband signals. In some of the equations below, lowercase letters denote coefficients or signals, and uppercase letters denote the corresponding powers, which can be seen from the context of the equations. Also, it should be noted that signals are sometimes represented by corresponding time-frequency-domain coefficients, rather than in the time-domain.

Assume that object #m (hearing object index m) is an object of interest, e.g., the most dominant object which is increased in its relative level and thus limits the overall sound quality. Then the ideal desired output signal (upmix channel signal) is given by $$\hat{y}_{1;} = [x_m \cdot r_m] + \left[\sum_{i=1;\, i\neq m}^{N} x_i \cdot r_i\right] \tag{1}$$

Herein, the first term is the desired contribution of the object of interest to the output signal, whereas the second term denotes the contributions from all the other objects ("interference").

In reality, however, due to the downmix process, the output signal is given by $$y_{1;} = t \cdot \sum_{i=1}^{N} x_i \cdot d_i = [x_m \cdot t \cdot d_m] + \left[\sum_{i=1;\, i\neq m}^{N} x_i \cdot t \cdot d_i\right] \tag{2}$$

i.e., the downmix signal is subsequently scaled by a transcoding coefficient, t, corresponding to the "m2" matrix in an MPEG Surround decoder. Again, this can be split into a first term (actual contribution of the object signal to the output signal) and a second term (actual "interference" by other object signals). Herein, the SAOC system (for example, the SAOC decoder 220, and, optionally, also the apparatus 240) dynamically determines the transcoding coefficient, t, such that the power of the actually rendered output signal is matched to the power of the ideal signal:

$$\hat{Y}_1 = Y_1 \Rightarrow t^2 = \frac{\sum_{i=1}^{N} r_i^2 \cdot X_i}{\sum_{i=1}^{N} d_i^2 \cdot X_i} \tag{3}$$

A distortion measure (DM) can be defined by computing the relation between the ideal power contribution of the object #m and its actual power contribution:

$$dm_1(m) = \frac{P_{ideal}}{P_{actual}} = \frac{r_m^2}{d_m^2 \cdot t^2} = \frac{r_m^2 \cdot \sum_{i=1}^{N} d_i^2 \cdot X_i}{d_m^2 \cdot \sum_{i=1}^{N} r_i^2 \cdot X_i} \tag{4}$$

Herein, $$\sum_{i=1}^{N} r_i^2 \cdot X_i$$

denotes the power of the finally rendered signal, and $$\sum_{i=1}^{N} d_i^2 \cdot X_i$$

is the power of the downmix signal. Note that, in an actual implementation, the $X_i$ values can be directly replaced by the corresponding Object Level Difference ($OLD_i$) values that are transmitted as part of the SAOC side information 214.

For a better interpretation of $dm_1$, its definition can be reformulated as follows:

$$dm_1(m) = \frac{r_m^2 \cdot \sum_{i=1}^{N} d_i^2 \cdot X_i}{d_m^2 \cdot \sum_{i=1}^{N} r_i^2 \cdot X_i} = \frac{\dfrac{r_m^2 \cdot X_m}{\sum_{i=1}^{N} r_i^2 \cdot X_i}}{\dfrac{d_m^2 \cdot X_m}{\sum_{i=1}^{N} d_i^2 \cdot X_i}} \tag{4a}$$

Effectively, this means that the distortion metric is the ratio of the relative object power contribution in the ideally rendered (output) signal versus in the downmix (input) signal. This goes together with the finding that the SAOC scheme works best when it does not have to alter the relative object powers by large factors.

Increasing values of $dm_1$ indicate decreasing sound quality with respect to sound object #m. It has been found that the value of $dm_1$ remains constant if all rendering coefficients are scaled by a common factor, or if all downmix coefficients are scaled likewise. Also it has been found that increasing the rendering coefficient for object #m (increasing its relative level) leads to increased distortion. The values of $dm_1$ can be interpreted as follows:

A value of 1 indicates ideal quality with respect to object #m;

Increasing $dm_1$ values above 1 indicate decreasing quality;

Values of $dm_1$ below 1 do not further improve quality with respect to object #m.

Consequently, an overall measure of sound scene quality (i.e. the quality for all objects) can be computed as follows:

$$DM_1 = \frac{\sum_{m=1}^{N} w(m) \cdot \max[dm_1(m), 1]}{\sum_{m=1}^{N} w(m)} \tag{5}$$

In this equation, w(m) indicates a weighting factor of object #m that relates to the significance and sensitivity of the particular object within the audio scene. As an example, w(m) then could be chosen depending on the object power/loudness $w(m)=(r_m^2 X_m)^{\alpha}$ where $\alpha$ may typically be chosen as 0.25 to roughly emulate the psychoacoustic loudness growth for this object. Furthermore, w(m) could take into account tonality and masking phenomena. Alternatively, w(m) can be set to 1, which facilitates the computation of $DM_1$.

2.3.2 Distortion Measure #2

An alternate distortion measure can be constructed by starting from equation (4) to form a perceptual measure in the style of a Noise-to-Mask-Ratio (NMR), i.e. compute the relation between noise/interference and masking threshold:

$$\begin{aligned} dm_2(m) &= \frac{P_{Noise}}{Mask} \\ &= \frac{P_{ideal} - P_{actual}}{msr \cdot P_{total}} \\ &= \frac{(r_m^2 - d_m^2 \cdot t^2) \cdot X_m}{msr \cdot \sum_{i=1}^{N} r_i^2 \cdot X_i} \\ &= \frac{\left(r_m^2 \cdot \sum_{i=1}^{N} d_i^2 \cdot X_i - d_m^2 \cdot \sum_{i=1}^{N} r_i^2 \cdot X_i\right) \cdot X_m}{msr \cdot \left(\sum_{i=1}^{N} r_i^2 \cdot X_i\right) \cdot \left(\sum_{i=1}^{N} d_i^2 \cdot X_i\right)} \end{aligned} \tag{6}$$

In this equation, msr is the Mask-To-Signal-Ratio of the total audio signal which depends on its tonality. Increasing values of $dm_2$ indicate higher distortion with respect to sound object #m. Again, the value of $dm_2$ remains constant if all rendering coefficients are scaled by a common factor, or if all downmix coefficients are scaled likewise. The value range of $dm_2$ can be interpreted as follows:

A value of 0 indicates ideal quality with respect to object #m;

Increasing $dm_2$ values above 1 indicate progressive audible degradations;

Values of $dm_2$ below 1 indicate indistinguishable quality with respect to object #m.

Consequently, an overall measure of sound scene quality (i.e. the quality for all objects) can be computed as follows:

$$DM_2 = \frac{\sum_{m=1}^{N} w(m) \cdot \max[dm_2(m), 1]}{\sum_{m=1}^{N} w(m)} \quad (7)$$

Again, w(m) indicates a weighting factor of object #m that relates to the significance/level/loudness of the particular object within the audio scene, typically chosen as $w(m)=(r_m^2 X_m)^{\alpha}$ with $\alpha=0.25$.

The distortion measure on equation (6) computes the distortion as the difference of the powers (this corresponds to an "NMR with spectral difference" measurement). Alternatively, the distortion can be computed on a waveform basis which leads to the following measure including an additional mixed product term:

$$dm_2'(m) = \frac{P_{Noise}}{\text{Mask}} = \frac{E\{|y_{m;ideal} - \hat{y}_{m;actual}|^2\}}{msr \cdot P_{total}} = \frac{\left| r_m^2 \cdot \sum_{i=1}^{N} d_i^2 \cdot X_i + d_m^2 \cdot \sum_{i=1}^{N} r_i^2 \cdot X_i - 2 \cdot d_m r_m \cdot \sqrt{\left(\sum_{i=1}^{N} r_i^2 \cdot X_i\right) \cdot \left(\sum_{i=1}^{N} d_i^2 \cdot X_i\right)} \right| \cdot X_m}{msr \cdot \left(\sum_{i=1}^{N} r_i^2 \cdot X_i\right) \cdot \left(\sum_{i=1}^{N} d_i^2 \cdot X_i\right)} \quad (8)$$

2.3.3 Distortion Measure #3

A third distortion measure is presented which describes the coherence between the downmix signal and the rendered signal. Higher coherence results in better subjective sound quality. Additionally the correlation of the input audio objects can be taken into account if IOC data is present at the SAOC decoder.

From SAOC parameters (e.g., parameters 214*a*, which may comprise object level difference parameters and inter-object-correlation parameters) a model of the object covariance can be determined $$E=\sqrt{\text{OLD}^T \cdot OLD} \cdot \text{IOC}$$

To calculate the distortion measure a Matrix M is assembled which contains the render and downmix coefficients (M can be interpreted as a rendering matrix for a N-1-2 SAOC system)

$$M = \begin{pmatrix} r_1 & r_2 & \dots & r_N \\ d_1 & d_2 & \dots & d_N \end{pmatrix}$$

The covariance between the downmix and rendered signal C is then $$C = M \cdot E \cdot M^* = \begin{pmatrix} c_{11} & c_{12} \\ c_{21} & c_{22} \end{pmatrix}$$

A distortion measure $DM_3$ is defined as $$DM_3 = 1 - \min\left(\frac{|c_{12}|}{\sqrt{c_{11} \cdot c_{22}}}, 1\right)$$

The values of $DM_3$ can be interpreted as follows:

Values are in the range [0 . . . 1] and indicate the coherence between downmix and rendered signal.

A value of 0 indicates ideal quality.

Increasing $DM_3$ values indicate decreasing quality.

2.3.4 Distortion Measure #4

2.3.4.1 Overview

This approach proposes to use as a distortion measure the averaged weighted ratio between the target rendering energy (UPMIX) and optimal downmix energy (calculated from given downmix DMX).

Figure 4:
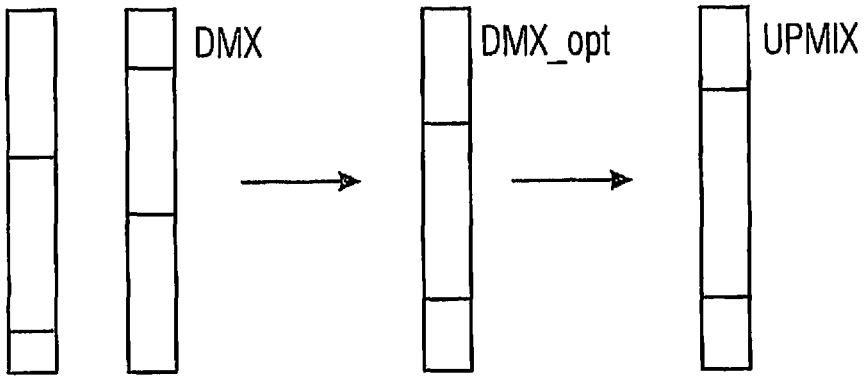
FIG. 4 shows a schematic representation of a contribution of object signals to a downmix signal and to a mixed signal.

For details, reference is also made to FIG. 4, which shows a graphical representation of the downmix (DMX), the optimal downmix energy (DMX_opt) and the target rendering energy (UPMIX).

2.3.4.2 Nomenclature ch={1, 2, . . . , $N_{ch}$} index for upmix channels dx={1,2} index for downmix channels ob={1, 2, . . . , $N_{ob}$} index for audio objects pb={1, 2, . . . , $N_{pb}$} index for parameter bands $r_{ch,ob,pb}$=r(ch,ob,pb) rendering matrix for channel ch, audio object ob and parameter band pb $d_{dx,ob,pb}$=d(dx,ob,pb) downmix matrix for downmix channel dx, audio object ob and parameter band pb $w_{ob,pb}$=w(ob, pb) weighting factor representing the significance/level/loudness of audio object ob for parameter band pb $NRG_{pb}$=NRG(pb) absolute object energy of the audio object with the highest energy for the frequency band pb $OLD_{ob,pb}$=OLD(ob, pb) object level difference, which describes the intensity differences between one audio object ob and the object with the highest energy for the corresponding frequency band pb $IOC_{ob_i,ob_j,pb}$=IOC($ob_i$,$ob_j$,pb) inter-object correlation, which describes the correlation between two channels of audio objects.

2.3.4.3 Algorithm

Steps of an algorithm for obtaining the distortion measure #4 will be briefly described in the following:

Calculation of the upmix and downmix relative energies:

$$\hat{r}_{ch,ob,pb}^2 = OLD_{ob,pb} \cdot r_{ch,ob,pb}^2, \hat{d}_{dx,ob,pb}^2 = OLD_{ob,pb} \cdot \hat{d}_{dx,ob}^2.$$

Normalization of energies such that $$\sum_{ob=1}^{N_{ob}} \hat{r}_{ch,ob,pb}^2 = 1 \text{ and } \sum_{ob=1}^{N_{ob}} \tilde{d}_{dm,ob,pb}^2 = 1: \hat{r}_{ch,ob,pb}^2 = \frac{\hat{r}_{ch,ob,pb}^2}{\sum_{ob=1}^{N_{ob}} \hat{r}_{ch,ob,pb}^2},$$

-continued $$\tilde{d}^2_{dm,ob,pb} = \frac{\tilde{d}^2_{dm,ob,pb}}{\sum_{ob=1}^{N_{ob}} \tilde{d}^2_{dm,ob,pb}}.$$

Construction of the optimal downmix $d_{ch,ob,pb}^{2(opt)}$ for each upmix channel and band:

$$d_{ch,ob,pb}^{2(opt)} = \alpha_{ch,ob,pb} \cdot \tilde{d}_{1,ob,pb}^2 + \beta_{ch,ob,pb} \cdot \tilde{d}_{2,ob,pb}^2.$$

The multiplicative constants $\alpha_{ch,ob,pb}$, $\beta_{ch,ob,pb}$ are calculated by solving the overdefined system of linear equations to satisfy the following condition:

$$\left\| d^{2(opt)}_{ch,ob,pb} - \tilde{r}^2_{ch,ob,pb} \right\| \xrightarrow[\alpha,\beta]{} 0.$$

Calculation of the distortion measure:

$$DM_4 = \sum_{ob=1}^{N_{ob}} \sum_{ch=1}^{N_{ch}} \left| 1 - \frac{\tilde{r}^2_{ch,ob,pb}}{d^{2(opt)}_{ch,ob,pb}} \right| w_{ob,pb} \hat{r}^2_{ch,ob,pb}.$$

2.3.4.4 Distortion Control

Distortion control is achieved by limiting one or more rendering coefficient(s) in dependence on the distortion measure DM4.

It may be noted that (i) the measure is relevant only for the stereo downmix case, and (ii) it can be reduced to DM1 for #dx=1 and #ch=1.

2.3.4.5 Properties

In the following, properties of the concept for calculating the distortion measure number 4 will be briefly summarized. The concept assumes ideal transcoding can handle stereo downmix; and allows for a generalization to a multiple channel rendering.

2.3.5 Distortion Measure #5

An alternative computation of the transcoding coefficient t is suggested. It can be interpreted as an extension of t and leads to the transcoding matrix T which is characterised by the incorporation of the inter-object coherence (IOC) and at the same time extends the current metrics DM#1 and DM#2 to stereo downmix and multichannel upmix. The current implementation of the transcoding coefficient t considers the match of the power of the actually rendered output signal to the power of the ideal rendered signal, i.e.

$$t^2 = \frac{\sum_{i=1}^{N} r_i^2 X_i}{\sum_{i=1}^{N} d_i^2 X_i}.$$

The incorporation of the covariance matrix E yields a modified formulation for t, namely the transcoding matrix T, that considers the inter-object coherence, too. The elements of E are computed from the SAOC parameters 214 as $$e_{ij} = \sqrt{OLD_i OLD_j} IOC_{ij}.$$

The transcoding matrix represents the conversion of the downmix to the rendered output signal such that TDx≈Rx. It is obtained through minimisation of the mean square error, yielding $$T = RED^*(DED^*)^{-1}$$

With H=RED* or $$h_{ij} = \sum_{i=1}^{N} \sum_{m=1}^{N} r_{il} d_{jm} e_{lm}$$

and V=DED* or $$v_{ij} = \sum_{i=1}^{N} \sum_{m=1}^{N} d_{il} d_{jm} e_{lm}$$

the distortion measure in the style of $dm_1$ but now for every downmix/rendering combination (n,k) of object m is given by $$dm_5^*(m, n, k) = \frac{r^2_{m,k} v_{n,n}}{d^2_{m,n} h_{k,n}}.$$

Considering $dm_1(m)$ separately for the left and right downmix channel leads to $$dm_L(m, k) = \frac{r^2_{m,k} v_{1,1}}{d^2_{m,1} h_{k,1}} \text{ and } dm_R(m, k) = \frac{r^2_{m,k} v_{2,2}}{d^2_{m,2} h_{k,2}}.$$

It can be assumed that the better of the two downmix/upmix paths is relevant for the quality of the rendered output, thus the measure corresponds to the minimum value, i.e.

$$dm_5'(m,k) = \min[dm_{1,}, dm_R].$$

An overall measure of all output channels, designated by index k, can be computed as $$dm_5(m) \frac{\sum_{k=1}^{N_{Ch}} dm_5'(m, k) r^2_{m,k} X_m}{\sum_{k=1}^{N_{Ch}} r^2_{m,k} e_{k,k}}.$$

The overall measure of all objects can be obtained by $$DM_5 = \frac{\sum_{m=1}^{N} w(m) \max[dm_5(m), 1]}{\sum_{m=1}^{N} w(m)} \text{ with } w(m) = [r^2_m X_m]^\alpha$$

as before.

A similar extension of t to T is possible for $dm_2$ and $dm_2'$.

2.3.6, Distortion Measure #6

In the following, a sixth distortion measure will be described.

Let $e_i(t)$ be the squared Hilbert envelope of object signal #i and $P_i$ the power of object signal #i (both typically within a subband), then a measure N of tonality/noise-likeness can be obtained from a normalized variance estimate of the Hilbert envelope like $$N_i = \frac{\mathrm{var}\{e_i\}}{P_i^2}$$

Alternatively, also the power/variance of the Hilbert envelope difference signal can be used instead of the variance of the Hilbert envelope itself. In any case, the measure describes the strength of the envelope fluctuation over time.

This tonality/noise-likeness measure, N, can be determined for both the ideally rendered signal mixture and the actually SAOC rendered sound mixture and a distortion measure can be computed from the difference between both, e.g.:

$$DM_6 = |N_{ideal} - N_{actual}|^{\beta}$$

where β is a parameter (e.g. β=2).

2.3.7. Calculating the Energies of the Source Signal Images for Reference Scene and SAOC Rendered Scene For calculating the object energies of the source image in the reference and SAOC rendered scene used for the distortion measures one have to take into account the transcoding matrix T for the SAOC rendered scene as it is done in "Distortion measure 5" but also the correlation of the source signals for both, the reference scene and the rendered scene.

Remark: The notation of the signals in uppercase reflect here the matrix notation of the signals, not the signals energies as in the chapters before For an arbitrary source $x_m$ the signal parts of $x_m$ in all sources $x_i$ can be calculated as follows:

Split all source signals $x_i$ into a signal part $x_{i||m}$ that is correlated to the object of interest $x_m$ and a part $x_{i\perp m}$ that is uncorrelated to $x_m$. This can be done by subspace projection of $x_m$ onto all signals $x_i$, i.e. $x_i = x_{i||m} + x_{i\perp m}$. The correlated part is given by $$x_{i||m} = \frac{x_m^T x_i}{x_m^T x_m} x_m = \frac{IOC_{i,m}}{\|x_m\|^2} x_m = g_{i,m} x_m.$$

2.33.1 Calculating $P_{Ideal,x_m}$ from the Image of Source $y_{x_m}$ in the Reference Scene y With Y=RX and $X = X_{\perp m} + X_{||m}$, the image $y_{x_m}$ of source $x_m$, for all rendered channels can be calculated via $Y_{x_m} = RX_{||m}$ where $$X_{||m} = \begin{pmatrix} x_{1||m}^T \\ x_{2||m}^T \\ \vdots \\ x_{N||m}^T \end{pmatrix} = \begin{pmatrix} g_{1,m} x_m^T \\ g_{2,m} x_m^T \\ \vdots \\ g_{N,m} x_m^T \end{pmatrix}$$

$Y_{x_m}$ can the be calculated by $$Y_{x_m} = RX_{||m} = \begin{pmatrix} r_{ch_1,x_1} & r_{ch_1,x_2} & \vdots & r_{ch_1,x_N} \\ r_{ch_2,x_1} & r_{ch_2,x_2} & \vdots & r_{ch_q,x_N} \\ \cdots & \cdots & \ddots & r_{N_{ch-1},x_N} \\ r_{N_{ch},x_1} & r_{N_{ch},x_2} & r_{N_{ch},x_{n-1}} & r_{N_{ch},x_N} \end{pmatrix} \begin{pmatrix} g_{1,m} x_m^T \\ g_{2,m} x_m^T \\ \vdots \\ g_{N,m} x_m^T \end{pmatrix}$$

Therefore the energy $P_{ideal,x_m}$ of source image $Y_{x_m}$ in the reference scene will be:

$$P_{ideal,x_m} = \begin{pmatrix} \|r_{ch_1,x_1} g_{1,m} + r_{ch_1,x_2} g_{2,m} + \ldots + r_{ch_1,x_N} g_{N,m}\|^2 \|x_m\|^2 \\ \cdots \\ \|r_{N_{ch},x_1} g_{1,m} + r_{N_{ch},x_2} g_{2,m} + \ldots + r_{N_{ch},x_N} g_{N,m}\|^2 \|x_m\|^2 \end{pmatrix}.$$

2.3.7.2 Calculating $P_{actual,x_m}$ from the Image of Source $\hat{y}_{x_m}$ in the SAOC Rendered Scene $\hat{y}$ This can be done in the same manner as for $P_{ideal,x_m}$. With T the transcoding matrix and D the downmix matrix, ŷhd $x_m$ for all channels in the rendered scene will be:

$$\hat{Y}_{x_m} = T^{0.5} D X_{||m}.$$

$$\text{Using } D = \begin{pmatrix} d_{11} & \cdots & d_{1N} \\ d_{21} & \cdots & d_{2N} \end{pmatrix} \text{ and } T = \begin{pmatrix} t_{11} & t_{12} \\ \vdots & \vdots \\ t_{N_{ch}1} & t_{N_{ch}2} \end{pmatrix}$$

$$\hat{Y}_{x_m} = \begin{pmatrix} \sqrt{t_{11}}\, d_{11} + \sqrt{t_{12}}\, d_{21} & \sqrt{t_{11}}\, d_{12} + \sqrt{t_{12}}\, d_{22} & \cdots & \sqrt{t_{11}}\, d_{1N} + t_{12} d_{2N} \\ \sqrt{t_{21}}\, d_{11} + \sqrt{t_{22}}\, d_{21} & \sqrt{t_{21}}\, d_{12} + \sqrt{t_{22}}\, d_{22} & \cdots & \sqrt{t_{21}}\, d_{1N} + t_{22} d_{2N} \\ \vdots & \vdots & \ddots & \vdots \\ \sqrt{t_{N_{ch}1}}\, d_{11} + \sqrt{t_{N_{ch}2}}\, d_{21} & \sqrt{t_{N_{ch}1}}\, d_{12} + \sqrt{t_{N_{ch}2}}\, d_{22} & \cdots & \sqrt{t_{N_{ch}1}}\, d_{1N} + \sqrt{t_{N_{ch}2}}\, d_{2N} \end{pmatrix} \begin{pmatrix} g_{1,m} x_m^T \\ g_{2,m} x_m^T \\ \vdots \\ g_{N,m} x_m^T \end{pmatrix}$$

Therefore the energy $P_{actual,x_m}$ of source image $\hat{Y}_{x_m}$ in the reference scene will be:

$$P_{actual,x_m} = \begin{pmatrix} \left\| g_{1,m}\left(\sqrt{t_{11}}\, d_{11} + \sqrt{t_{12}}\, d_{21}\right) + g_{2,m}\left(\sqrt{t_{11}}\, d_{12} + \sqrt{t_{12}}\, d_{22}\right) + \ldots g_{N,m}\left(\sqrt{t_{11}}\, d_{1N} + \sqrt{t_{12}}\, d_{2N}\right) \right\|^2 \|x_m\|^2 \\ \ldots \\ \left\| g_{1,m}\left(\sqrt{t_{N_{ch}1}}\, d_{11} + \sqrt{t_{N_{ch}2}}\, d_{21}\right) + g_{2,m}\left(\sqrt{t_{N_{ch}1}}\, d_{12} + \sqrt{t_{N_{ch}2}}\, d_{22}\right) + \ldots g_{N,m}\left(\sqrt{t_{N_{ch}1}}\, d_{1N} + \sqrt{t_{N_{ch}2}}\, d_{2N}\right) \right\|^2 \|x_m\|^2 \end{pmatrix}$$

2.3.7.3. Calculating the Distortion Measure

The distortion measure in the style of $dm_1$ can be calculated for every object m and output rendering channel k as $$dm_7'(m,k) = \frac{P_{ideal}}{P_{actual}} = \frac{\|r_{k1} IOC_{lm} + \ldots + r_{kN} IOC_{Nm}\|^2}{\left\|\left(\sqrt{t_{k1}}\, d_{11} + \sqrt{t_{k2}}\, d_{21}\right) IOC_m + \ldots + \left(\sqrt{t_{k1}}\, d_{1N} + \sqrt{t_{k2}}\, d_{2N}\right) IOC_{Nm}\right\|^2}.$$

$$dm_7(m) \frac{\sum_{k=1}^{N_{Ch}} dm_7'(m,k) r_{m,k}^2 \|x_m\|^2}{\sum_{k=1}^{N_{Ch}} r_{m,k}^2 e_{k,k}}.$$

$$DM_7 = \frac{\sum_{m=1}^{N} w(m) \max[dm_7(m), 1]}{\sum_{m=1}^{N} w(m)} \text{ with } w(m) = [r_m^2 X_m]^{\alpha}$$

as before.

2.3.8 Object-Signal Properties

In the following, an example of object-signal properties will be described which may be used, for example, by the apparatus 250 or the artifact reduction 320 in order to obtain a distortion measure.

In the SAOC processing, several audio object signals are downmixed into a downmix signal which is then used to generate the final rendered output. If a tonal object signal is mixed together with a more noise-like second object signal of equal signal power, the result tends to be noise-like. The same holds, if the second object signal has a higher power. Only, if the second object signal has a power that is substantially lower than the first one, the result tends to be tonal. In the same way, the tonality/noise-likeness of the rendered SAOC output signal is mostly determined by the tonality/noise-likeness of the downmix signal regardless of the applied rendering coefficients. In order to achieve good subjective output quality, also the tonality/noise-likeness of the actually rendered signal should be close to the tonality/noise-likeness of the ideally rendered signal. In order to use this concept in the distortion measure, it is necessitated to transmit the information about each object's tonality/noise-likeness as part of the bitstream. The tonality/noise-likeness N of the ideally rendered output can then be estimated in the SAOC decoder as a function of the tonality/noise-likeness of each object $N_i$ and its object power $P_i$, i.e.

$$N = f(N_1, P_1, N_2, P_2, N_3, P_3, \ldots)$$

and compared to the tonality/noise-likeness of the actually rendered output signal in order to compute a distortion measure. As an example, the following function f( ) may be used:

$$N = \frac{\sum_i N_i \cdot P_i^{\alpha}}{\left(\sum_i P_i\right)^{\alpha}}$$

which combines object tonality/noise-likeness values and object powers into a single output estimating the tonality/noise-likeness value of the mixture of the signals. The parameter $\alpha$ can be chosen to optimize the precision of the estimation procedure for a given tonality/noise-likeness measure (e.g. $\alpha$=2). A suitable distortion metric based on tonality/noise-likeness is described in Section 2.3.6 as distortion measure #6.

2.4 Distortion Limiting Schemes 2.4.1 Overview of the Distortion Limiting Schemes In the following, a short overview of a plurality of distortion limiting schemes will be given. As discussed above, the rendering coefficient adjuster 250 receives the input rendering coefficients 242 and provides, on the basis thereof, a modified rendering coefficient 222 for use by the SAOC decoder 220.

Different concepts for the provision of the modified rendering coefficients can be distinguished, wherein the concepts can also be combined in some embodiments. According to the first concept, one or more rendering parameter limit values are obtained in a first step in dependence on one or more parameters of the side information 214 (i.e., in dependence on the object-related parametric information 214). Subsequently, the actual "(modified or adjusted)" rendering coefficients 222 are obtained in dependence on the desired rendering parameter 242 and the one or more rendering parameter limit values, such that the actual rendering parameters obey the limits defined by the rendering parameter limit values. Accordingly, such rendering parameters, which exceed the rendering parameter limit values, are adjusted (modified) to obey the rendering parameter limit values. This first concept is easy to implement but may sometimes bring along a slightly degraded user satisfaction, because the user's choice of the desired rendering parameters 242 is left out of consideration if the user-defined desired rendering parameters 242 exceed the rendering parameter limit values.

According to the second concept, the parameter adjuster computes a linear combination between a square of a desired rendering parameter and a square of an optimal rendering parameter, to obtain the actual rendering parameter. In this case, the parameter adjuster is configured to determine a contribution of the desired rendering parameter and of the optimal rendering parameter to the linear combination in dependence on a predetermined threshold parameter and a distortion metric (as described above).

In addition, it can be distinguished whether the distortion measure (distortion metric) is computed using inter-object relationship properties and/or individual object properties. In some embodiments, only inter-object-relationship properties are evaluated while leaving individual object properties (which are related to a single object only) out of consideration. In some other embodiments, only individual object properties are considered while leaving inter-object-relationship properties out of consideration. However, in some embodiments, a combination of both inter-object-relationship properties and individual object properties are evaluated.

Based on the previous considerations, and also based on the above discussion of different distortion measures, a number of schemes for limiting the distortion will be defined, as outlined in the following subsections. These schemes for limiting the distortion may be applied by the rendering coefficient adjuster 250 in order to obtain the modified rendering coefficients in dependence on the input rendering coefficients 242.

2.4.2 Distortion Limiting Scheme #1

In subsection 2.3.1 a simple distortion measure was defined by computing the relation between the ideal power contribution of the object #m and its actual power contribution (equation 4):

$$dm_1(m) = \frac{P_{ideal}}{P_{actual}} = \frac{r_m^2}{d_m^2 \cdot t^2} = \frac{r_m^2 \cdot \sum_{i=1}^{N} d_i^2 \cdot X_i}{d_m^2 \cdot \sum_{i=1}^{N} r_i^2 \cdot X_i} \tag{4}$$

In this equation, the only variables that are under the control of the SAOC renderer are the rendering coefficients that are used in the transcoding process. So if the resulting distortion metric shall not exceed a certain threshold value, T, this imposes a condition on the corresponding rendering matrix coefficient:

$$dm_1(m) = \frac{r_m^2 \cdot \sum_{i=1}^{N} d_i^2 \cdot X_i}{d_m^2 \cdot \sum_{i=1}^{N} r_i^2 \cdot X_i} \le T \Leftrightarrow r_m^2 \le \hat{r}_m^2 = T \cdot \frac{d_m^2 \cdot \sum_{i=1, i \ne m}^{N} r_i^2 \cdot X_i}{\left| \sum_{i=1}^{N} d_i^2 \cdot X_i - T \cdot d_m^2 \cdot X_m \right|} \tag{6.1.a}$$

To find a solution for all $\hat{r}_m^2$ a set of linear equations Ax=b can be set up where $$x = \begin{bmatrix} \hat{r}_1^2 \\ \hat{r}_2^2 \\ \vdots \\ \hat{r}_N^2 \end{bmatrix}, b = \begin{bmatrix} 0 \\ 0 \\ \vdots \\ \sum_{i=1}^{N} r_i^2 \end{bmatrix} \text{ and } A = \begin{bmatrix} -c_1 & d_1^2 X_2 & \dots & d_1^2 X_N \\ d_2^2 X_1 & -c_2 & \dots & d_2^2 X_N \\ \vdots & \vdots & \ddots & \vdots \\ d_N^2 X_1 & d_N^2 X_2 & \dots & -c_N \\ 1 & 1 & 1 & 1 \end{bmatrix}$$

-continued $$\text{with } c_m = \frac{1}{T}\left( \sum_{i=1}^{N} d_i^2 \cdot X_i - T \cdot d_m^2 \cdot X_m \right).$$

The first N rows of A are directly derived from equation (6.1.a). Additionally a constraint is added so that the energy of the new (limited) rendering coefficients equals the energy of the user specified coefficients. A solution for $\hat{r}_m^2$ (which may be considered as rendering parameter limit values) is then obtained as:

$$x = (A^T A)^{-1} A^T b$$

Starting with this, a first simplistic distortion limiting scheme can be seen as follows: Instead of using the rendering matrix coefficients 242 as they are provided to the SAOC decoder from the user interface, the effectively used rendering coefficient $r_m'$, 222 for object #m is modified/limited (for example, by the rendering coefficient adjuster 240 on a per frame basis before being used for the SAOC decoding process:

$$\hat{r}'^2_m = \min(r_m^2, \hat{r}_m^2)$$

Note that the limiting process depends on the individual object energies in each particular frame. The approach is simple, and has the following minor shortcomings:

- It does not consider relative object loudness nor perceptual masking; and
- It only captures the effects of boosting a particular object, but does not capture the effects by attenuating object gains. This could be addressed by also mandating a lower bound on the dm value.

2.4.3 Limiting Scheme #2

2.4.3.1 Limiting Scheme Overview

This section describes a limiting function considering the following aspects:

- the distortion measure is restricted by a limiting threshold,
- the derivation of the limited rendering matrix is based on the limiting function and on its distance to the initial rendering matrix.

This limiting function (or limiting scheme) may, for example, be performed by the rendering coefficient adjuster 250 in combination with the distortion calculator 260.

The distortion measure is a function of the rendering matrix, so that

- an initial rendering matrix (described, for example, by the input rendering coefficients 242) yields an initial distortion measure,
- the optimal distortion measure yields an optimal rendering matrix, but the distance of this optimal rendering matrix to the initial rendering matrix may not be optimal,
- the distortion measure is invers linear proportional to the distance of a rendering matrix to the initial rendering matrix,
- for a certain threshold the limited rendering matrix (described, for example, by the adjusted or modified rendering coefficients 222) is derived through interpolation (for example, linear interpolation) between the initial and optimal working point.

Additionally, the power of the rendered signal in each working point can be assumed approximately constant, so that $$\sum_{i=1}^{N_{ob}} r_i^2 X_i \approx \sum_{i=1}^{N_{ob}} r_{lim,i}^2 X_i \approx \sum_{i=1}^{N_{ob}} r_{opt,i}^2 X_i.$$

The limiting scheme #2 can be used in combination with different distortion measures, as will be discussed in the following.

2.4.3.2 Limiting of Distortion Measure #1

For each parameter band the distortion measure $dm_1(m)$ for an object of interest m is defined as $$dm_1(m) = \frac{r_m^2 \sum_{i=1}^{N_{ob}} d_i^2 X_i}{d_m^2 \sum_{i=1}^{N_{ob}} r_i^2 X_i}.$$

The optimal rendering matrix results when setting $dm_1(m)$ to its optimal value, i.e. $dm_{1,opt}(m)=1$ $$r_{opt,m}^2 = d_m^2 \frac{\sum_{i=1}^{N_{ob}} r_i^2 X_i}{\sum_{i=1}^{N_{ob}} d_i^2 X_i}.$$

Accordingly, the optimal rendering matrix values $r_{opt,m}^2$ can be obtained by using a system of equations, wherein $r_t^2$ is replaced by $r_{opt,i}^2$.

With the pre-defined threshold T for $dm_1(m)$ the limited rendering matrix is given by $$r_{lim,m}^2 = \frac{T-1}{dm_1(m)}(r_m^2 - r_{opt,m}^2) + r_{opt,m}^2.$$

2.4.3.3 Limiting of Distortion Measure #2a

Distortion measure $dm_{2a}(m)$, which is also sometimes briefly designated as "$dm_2(m)$", is defined as $$dm_{2a}(m) = \frac{\left(r_m^2 \sum_{i=1}^{N_{ob}} d_i^2 X_i - d_m^2 \sum_{i=1}^{N_{ob}} r_i^2 X_i\right) X_m}{msr \sum_{i=1}^{N_{ob}} r_i^2 X_i \sum_{i=1}^{N_{ob}} d_i^2 X_i} = \frac{\frac{r_m^2 X_m}{\sum_{i=1}^{N_{ob}} r_i^2 X_i} - \frac{d_m^2 X_m}{\sum_{i=1}^{N_{ob}} d_i^2 X_i}}{msr}$$

for object m and each parameter band. For a certain parameter band pb the mask to signal ration msr(pb) is a function of the power of the rendered signal $$msr(pb) = \left[\sum_{i=1}^{N_{ob}} r_i^2 X_i M_k\right]_{k=max(pb)} = \left[\sum_{i=1}^{N_{ob}} r_i^2 X_i\right]_{k=max(pb)} [M_k]_{k=max(pb)}.$$

The optimal value for the distortion measure is zero, i.e. $dm_{2a,opt}(m)=0$. This corresponds to a prefect transcoding process that does not introduce any error. Hence, the optimal rendering matrix yields $$r_{opt,m}^2 = d_m^2 \frac{\sum_{i=1}^{N_{ob}} r_i^2 X_i}{\sum_{i=1}^{N_{ob}} d_i^2 X_i}.$$

With $dm_{2a}(m)=T$ the limited rendering matrix, which may be described by the modified rendering coefficients 222, becomes $$r_{lim,m}^2 = \frac{T-1}{dm_{2a}(m)}(r_m^2 - r_{opt,m}^2) + r_{opt,m}^2.$$

2.4.3.4 Limiting of Distortion Measure #2b

The distortion measure $dm_{2b}(m)$, which is also sometimes briefly designated as $dm_{2'}(m)$, may also be used by the apparatus 240 for obtaining the limited rendering matrix, which may be described by the modified rendering coefficients 222, in dependence on the input rendering coefficients 242.

2.4.3.5 Limiting of Distortion Measure #4

Distortion measure $dm_4(m)$ is defined as $$dm_4(m) = \left| 1 - \frac{r_m^2 \sum_{i=1}^{N_{ob}} d_i^2 X_i}{d_m^2 \sum_{i=1}^{N_{ob}} r_i^2 X_i} \right|$$

for object m and each parameter band and its optimal value is $dm_{4,opt}(m)=0$. Consequently the optimal and limited rendering matrices result in $$r_{opt,m}^2 = d_m^2 \frac{\sum_{i=1}^{N_{ob}} r_i^2 X_i}{\sum_{i=1}^{N_{ob}} d_i^2 X_i} \text{ and}$$

$$r_{lim,m}^2 = \frac{T-1}{dm_4(m)}(r_m^2 - r_{opt,m}^2) + r_{opt,m}^2.$$

Accordingly, the apparatus 240 may provide the modified rendering coefficients 222 in dependence on the input rendering coefficients 242 and also in dependence on the distortion measure 252, which may be equal to the fourth distortion measure $dm_4(m)$.

2.4.4 Limiting Scheme #3

Corresponding to formula (6.1.a) the limited rendering coefficient for object m can be calculated for distortion measure #3 as follows. With the abbreviations $$c_1 = \sum_{i=1}^{N}\sum_{j=1}^{N} d_i d_j e_{ij},\ c_2 = \sum_{i=1, i\neq m}^{N} r_i e_{im},\ c_3 = \sum_{i=1, i\neq m}^{N}\sum_{j=1, j\neq m}^{N} r_i r_j e_{ij},$$

$$c_4 = \sum_{i=1}^{N} d_i e_{mi} \text{ and } c_5 = \sum_{i=1, i\neq m}^{N}\sum_{j=1}^{N} r_i d_j e_{ij}$$

a quadratic equation is set up $$\hat{r}_m^2((1-T)^2\cdot c_1 e_{mm}-c_4^2)+\hat{r}_m\cdot 2\cdot((1-T)^2\cdot c_1 c_2-c_4 c_5)+(1-T)^2\cdot c_1 c_3-c_5^2=a\cdot\hat{r}_m^2+b\cdot\hat{r}_m+c=0$$

whose (positive) solution is $$\hat{r}_m = \frac{-b+\sqrt{b^2-4ac}}{2a} \tag{6.2.a}$$

Accordingly, the apparatus 240 may comprise rendering parameter limit values $\hat{r}_m$, and may limit the adjusted (or modified) rendering coefficients 222 in accordance with said rendering parameter limit values.

2.4.5 Further Optional Improvements

The above described concept for limiting the rendering coefficients 222, which are performed individually or in combination by the apparatus 240, can be further improved. For example, a generalization to M-channel rendering can be performed. For this purpose, the sum of squares/power of rendering coefficients can be used instead of a single rendering coefficient.

Also, a generalization to a stereo downmix can be performed. For this purpose, a sum of squares/power of downmix coefficients can be used instead of a single downmix coefficient.

In some embodiments distortion metrics can be combined across frequency into a single one that is used for degradation control. Alternatively, it may be better (and simpler) in some cases to do distortion control independently for each frequency band.

Different concepts can be applied for actually doing the distortion control. For example, the one or more rendering coefficients can be limited. Alternatively, or in addition, a m2 matrix coefficient (for example of an MPEG Surround decoding) can be limited. Alternatively, or in addition, a relative object gain can be limited.

3. Embodiment According to FIG. 3

In the following, another embodiment of an SAOC decoder will be described taking reference to FIG. 3. In order to facilitate the understanding, a brief discussion of the underlying considerations will be given first. The output of a "spatial audio object coding" (SAOC) system (like that under standardization as ISO/IEC 23003-2) can exhibit artifacts that depend on the properties of the audio object and the relation between the rendering matrix and the downmix matrix. To discuss this problem, the case where downmix and rendering matrices have the same dimension is considered here without loss of generality. Corresponding considerations apply if the number of channels in the downmix and the rendered scene are different.

It has been found that, in general, the risk of artifacts increases when the rendering matrix becomes significantly different from the downmix matrix. Different types of artifacts can be distinguished:

1. Imperfections of the rendering, i.e., that the "effective" rendering matrix differs from the desired rendering matrix that is input to the SAOC decoder (the effectively achieved attenuation or gain of an object is different from what is specified in the rendering matrix). This is typically the effect from overlap of objects in certain parameter bands.
2. Undesired and possibly even time-variant changes of the timbre of an object. This artifact is especially severe when the "leakage" mentioned in 1. only occurs locally for a single parameter band.
3. Artifacts, like modulated object signals, musical tones, or modulated noise, caused by the time- and frequency-variant signal processing in the SAOC decoder.

It has been found that it is desirable to minimize all types of artifacts.

A generalized approach to address this problem and to minimize the artifacts is to employ a time-frequency-variant post-processing of the desired rendering matrix before it is sent to the SAOC decoder. This approach is shown in FIG. 3.

Figure 3:
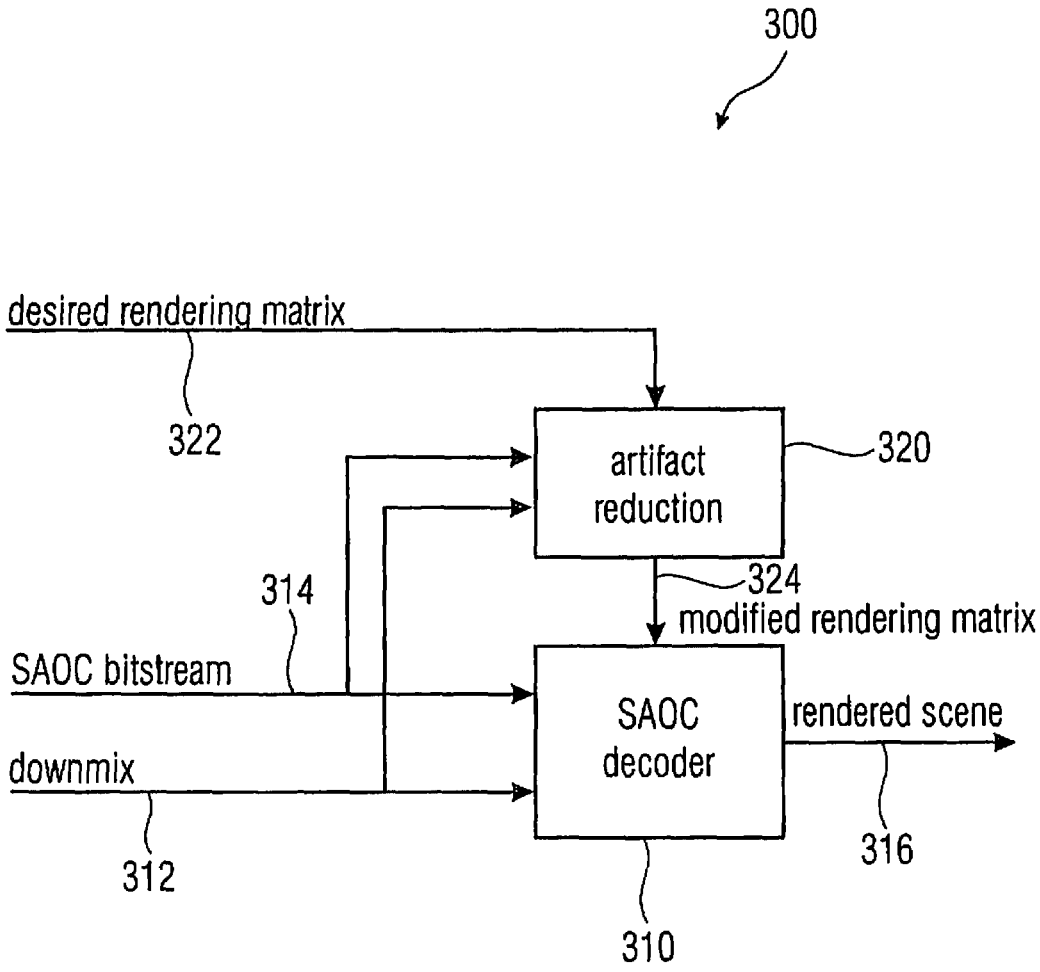
FIG. 3 shows a block schematic diagram of an MPEG SAOC system, according to another embodiment of the invention.

FIG. 3 shows a block schematic diagram of an SAOC decoder arrangement 300. The SAOC decoder 300 may also briefly be designated as an audio signal decoder. The audio signal decoder 300 comprises an SAOC decoder core 310, which is configured to receive a downmix signal representation 312 and an SAOC bitstream 314 and to provide, on the basis thereof, a description 316 of a rendered scene, for example, in the form of a representation of a plurality of upmix audio channels.

The audio signal decoder 300 also comprises an artifact reduction 320, which may, for example, be provided in the form of an apparatus for providing one or more adjusted parameters in dependence on one or more input parameters. The artifact reduction 320 is configured to receive information 322 about a desired rendering matrix. The information 322 may, for example, take the form of a plurality of desired rendering parameters, which may form input parameters of the artifact reduction. The artifact reduction 320 is further configured to receive the downmix signal representation 312 and the SAOC bitstream 314, wherein the SAOC bitstream 314 may carry an object-related parametric information. The artifact reduction 320 is further configured to provide a modified rendering matrix 324 (for example, in the form of a plurality of adjusted rendering parameters) in dependence on the information 322 about the desired rendering matrix.

Consequently, the SAOC decoder core 310 may be configured to provide the representation 316 of the rendered scene in dependence on the downmix signal representation 312, the SAOC bitstream 314 and the modified rendering matrix 324.

In the following, some details regarding the functionality of the audio signal decoder will be provided. It has been found that in order to assess the risk of artifacts due to potentially limited separation capabilities of the SAOC system for a given desired rendering matrix, it is desirable to take both the downmix signal (described by the downmix signal representation 312) and the SAOC bitstream 314 into account. With this information at hand, it is possible to attempt mitigating these artifacts, for example, by modification of the rendering matrix. This is performed by the artifact reduction 320. Advanced strategies for mitigation take both the limitations (overlap) of the time- and frequency-selectivity of the SAOC system as well as perceptual effects into account, i.e., they should try to make the rendered signal sound as similar to the desired output signal while having as little as possible audible artifacts.

An approach for artifact reduction, which is used in the audio signal decoder 300 shown in FIG. 3, is based on an overall distortion measure that is a weighted combination of distortion measures assessing the different types of artifacts listed above. These weights determine a suitable tradeoff between the different types of artifacts listed above. It should be noted that the weights for these different types of artifacts can be dependent on the application in which the SAOC system is used.

In other words, the artifact reduction 320 may be configured to obtain distortion measures for a plurality of types of artifacts. For example, the artifact reduction 320 may apply some of the distortion measures $dm_1$ to $dm_6$ discussed above. Alternatively, or in addition, the artifact reduction 320 may use further distortion measures describing other types of artifacts, as discussed within this section. Also, the artifacts reduction may be configured to obtain the modified rendering matrix 324 on the basis of the desired rendering matrix 322 using one or more of the distortion limiting schemes, which have been discussed above (for example, under sections 2.4.2, 2.4.3 and 2.4.4), or comparable artifact limiting schemes.

4. Audio Signal Transcoders According to FIGS. 5*a* and 5*b*

Figure 5A:
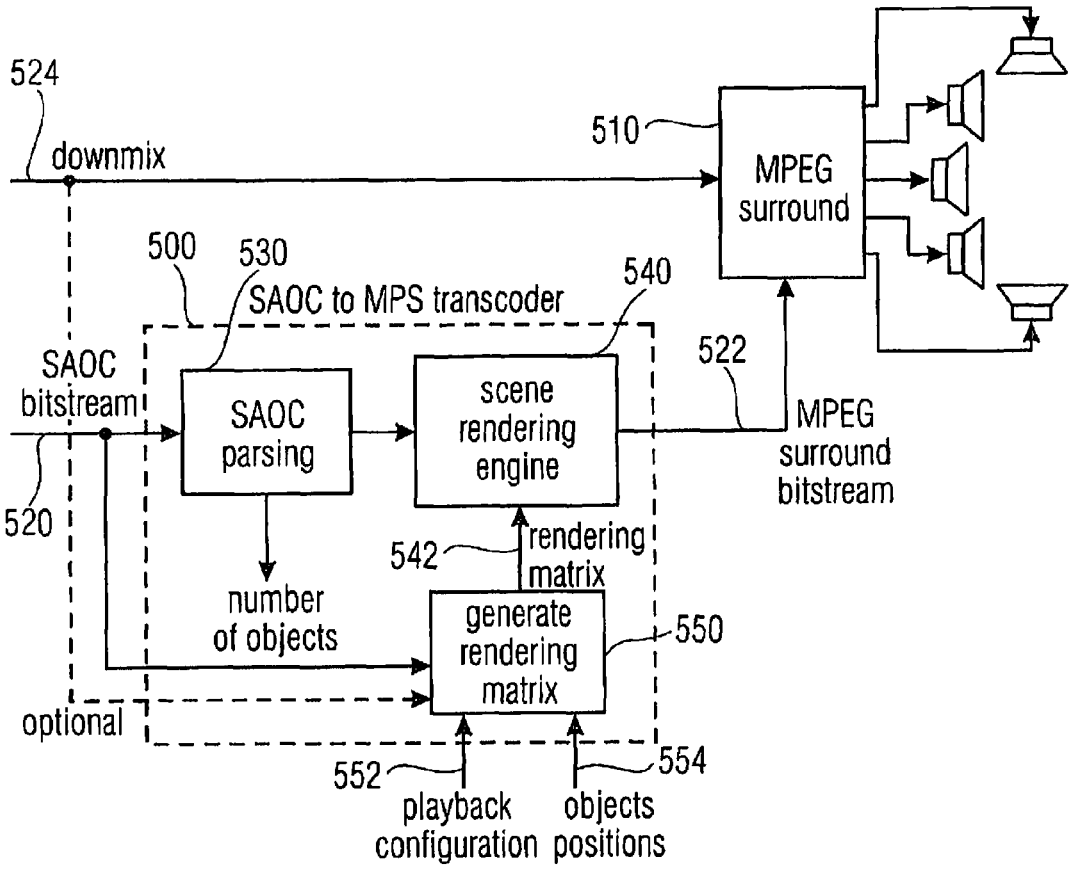
FIG. 5*a* shows a block schematic diagram of a mono downmix-based SAOC-to MPEG Surround transcoder, according to an embodiment of the invention.

4.1 Audio Signal Transcoder According to FIG. 5*a*

It should be noted that the concepts described above can be applied in both an audio signal decoder and an audio signal transcoder. Taking reference to FIGS. 2 and 3, the concept has been described in combination with audio signal decoders. In the following, the usage of the inventive concept will briefly be discussed in combination with audio signal transcoders.

Figure 9A:
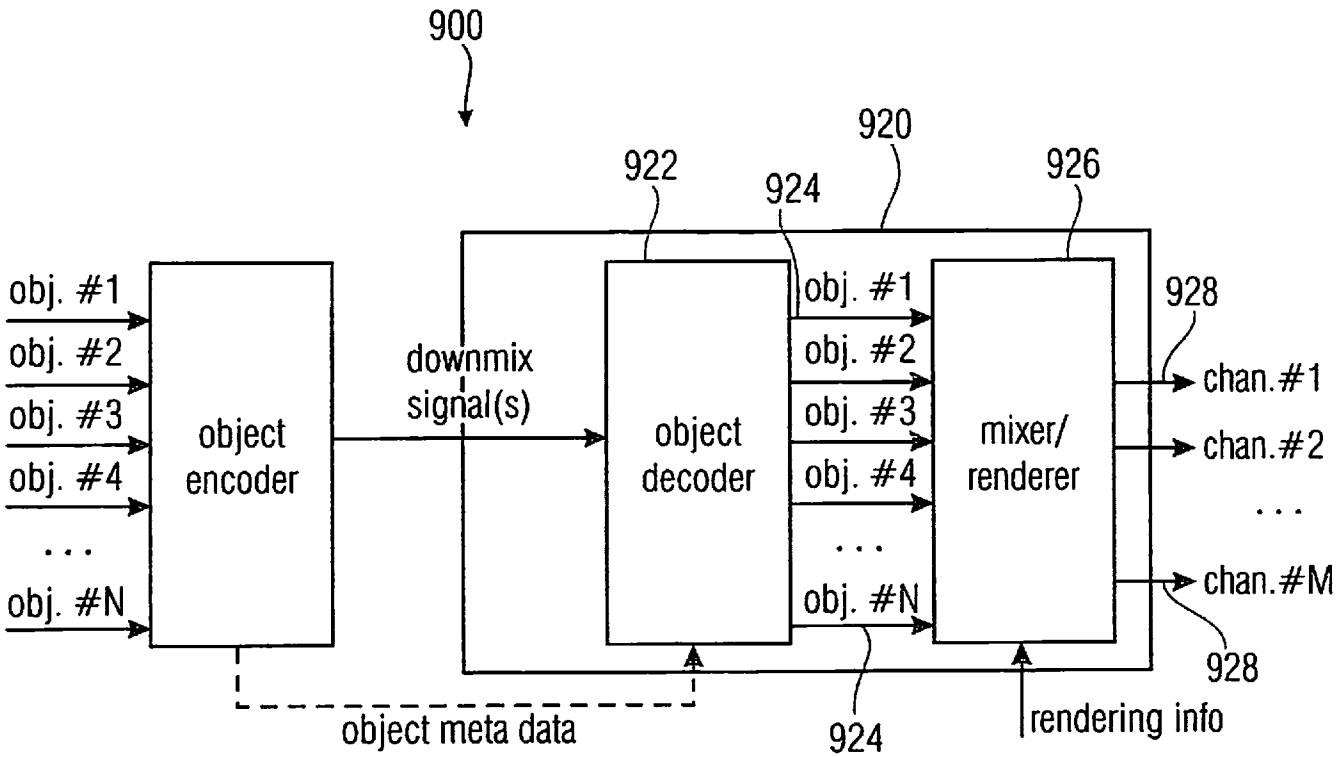
FIG. 9*a* shows a block schematic diagram of a reference SAOC system using a separate decoder and mixer.
Figure 9B:
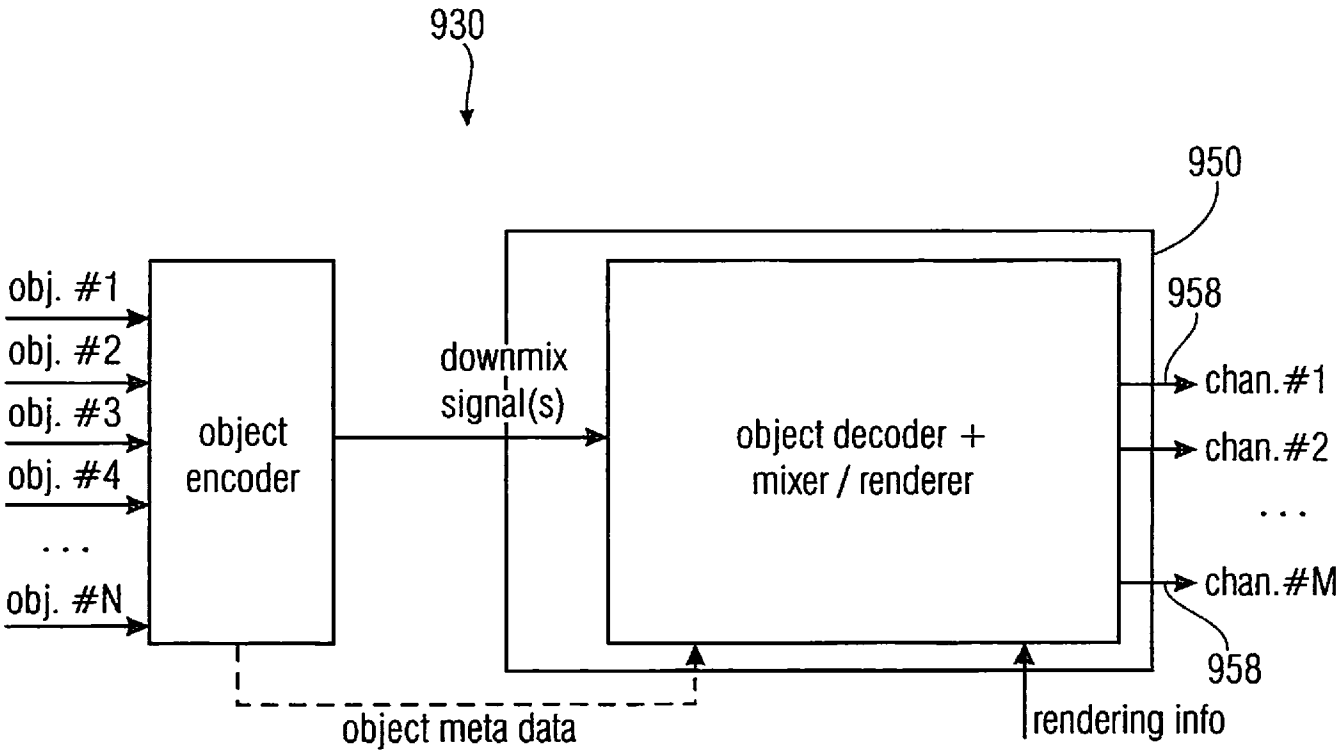
FIG. 9*b* shows a block schematic diagram of a reference SAOC system using an integrated decoder and mixer.
Figure 9C:
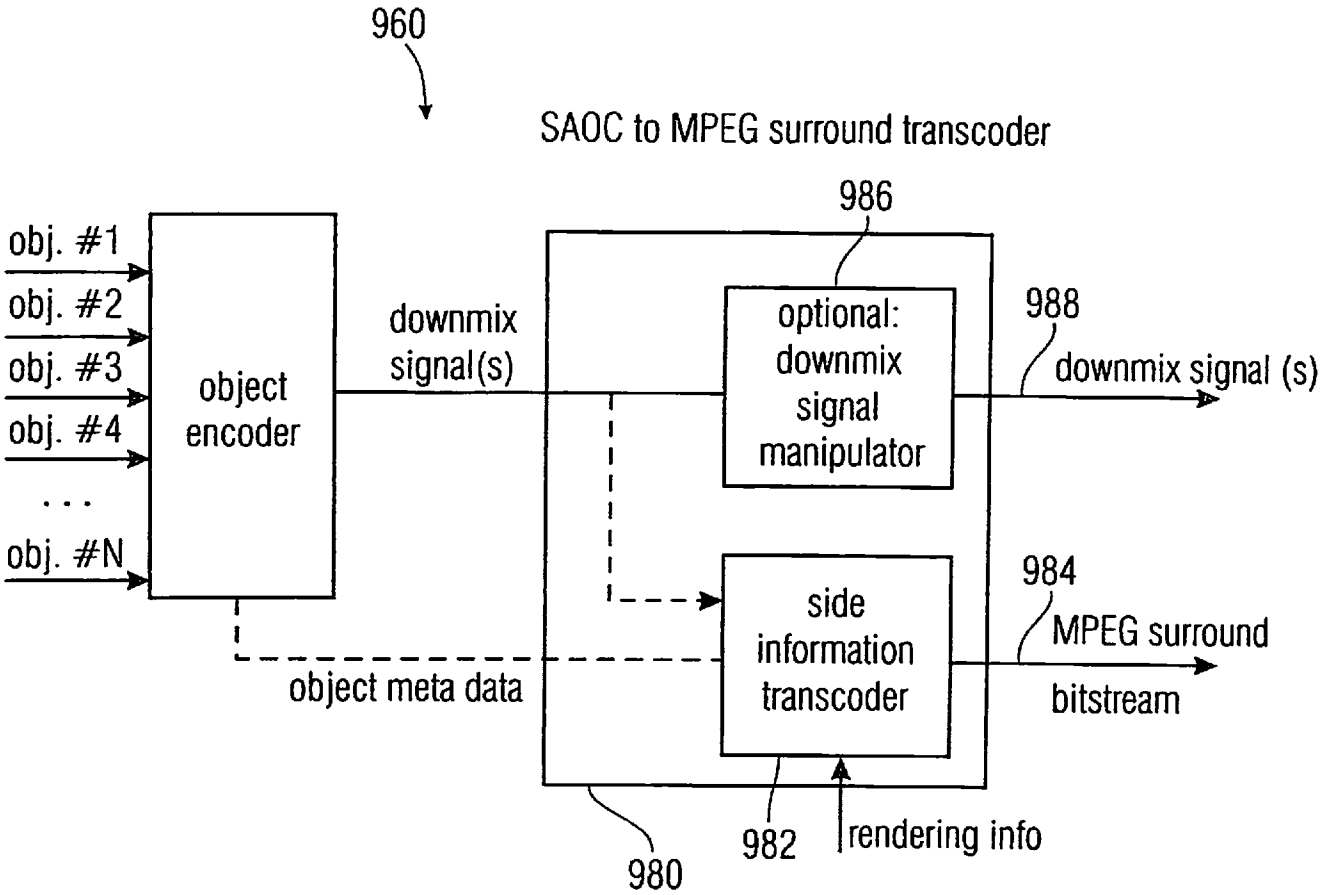
FIG. 9*c* shows a block schematic diagram of a reference SAOC system using an SAOC-to-MPEG transcoder.

Regarding this issue, it should be noted that the similarities of audio signal decoders and audio signal transcoders have already been discussed with reference to FIGS. 9*a*, 9*b* and 9*c*, such that the explanations made with respect to FIGS. 9*a*, 9*b* and 9*c* are applicable to the inventive concept.

FIG. 5*a* shows a block schematic diagram of an audio signal transcoder 500 in combination with an MPEG Surround decoder 510. As can be seen, the audio signal transcoder 500, which may be an SAOC-to-MPEG Surround transcoder, is configured to receive an SAOC bitstream 520 and to provide, on the basis thereof, an MPEG Surround bitstream 522 without affecting (or modifying) a downmix signal representation 524. The audio signal transcoder 500 comprises an SAOC parsing 530, which is configured to receive the SAOC bitstream 520 and to extract desired SAOC parameters from the SAOC bitstream 530. The audio signal transcoder 500 also comprises a scene rendering engine 540, which is configured to receive SAOC parameters provided by the SAOC parsing 530 and a rendering matrix information 542, which may be considered as an actual rendering (matrix) information, and which may be represented, for example, in the form of a plurality of adjusted (or modified) rendering parameters. The scene rendering engine 540 is configured to provide the MPEG Surround bitstream 522 in dependence on said SAOC parameters and the rendering matrix 542. For this purpose, the scene rendering engine 540 is configured to compute the MPEG Surround bitstream parameters 522, which are channel-related parameters (also designated as parametric information). Thus, the scene rendering engine 540 is configured to transform (or "transcoder") the parameters of the SAOC bitstream 520, which constitutes an object-related parametric information, into the parameters of the MPEG Surround bitstream, which constitutes a channel-related parametric information, in dependence on the actual rendering matrix 542.

The audio signal transcoder 500 also comprises a rendering matrix generation 550, which is configured to receive an information about a desired rendering matrix, for example, in the form of an information 552 about a playback configuration and an information 554 about object positions. Alternatively, the rendering matrix generation 550 may receive information about desired rendering parameters (e.g, rendering matrix entries). The rendering matrix generation is also configured to receive the SAOC bitstream 520 (or, at least, a subset of the object-related parametric information represented by the SAOC bitstream 520). The rendering matrix generation 550 is also configured to provide the actual (adjusted or modified) rendering matrix 542 on the basis of the received information. Insofar, the rendering matrix generation 550 may take over the functionality of the apparatus 100 or of the apparatus 240.

The MPEG Surround decoder 510 is typically configured to obtain a plurality of upmix channel signals on the basis of the downmix signal information 524 and the MPEG Surround stream 522 provided by the scene rendering engine 540.

To summarize, the audio signal transcoder 500 is configured to provide the MPEG Surround bitstream 522 such that the MPEG Surround bitstream 522 allows for a provision of an upmix signal representation on the basis of the downmix signal representation 524, wherein the upmix signal representation is actually provided by the MPEG Surround decoder 510. The rendering matrix generation 550 adjusts the rendering matrix 542 used by the scene rendering engine 540 such that the upmix signal representation generated by the MPEG Surround decoder 510 does not comprise an inacceptable audible distortion.

Figure 5B:
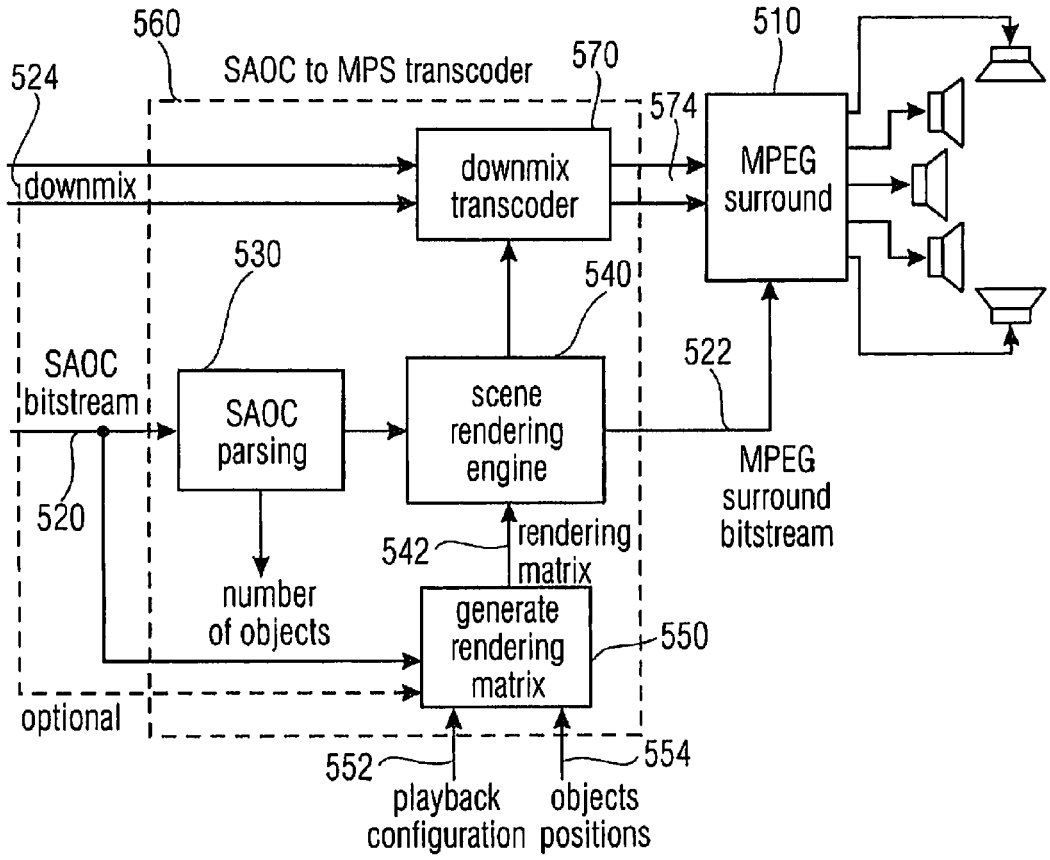
FIG. 5*b* shows a block schematic diagram of a stereo downmix-based SAOC-to MPEG Surround transcoder, according to an embodiment of the invention.

4.2 Audio Signal Transcoder According to FIG. 5*b*

FIG. 5*b* shows another arrangement of an audio signal transcoder 560 and an MPEG Surround decoder 510. It should be noted that the arrangement of FIG. 5*b* is very similar to the arrangement of FIG. 5*a*, such that identical means and signals are designated with identical reference numerals. The audio signal transcoder 560 differs from the audio signal transcoder 500 in that the audio signal transcoder 560 comprises a downmix transcoder 570, which is configured to receive the input downmix representation 524 and to provide a modified downmix representation 574, which is fed to the MPEG Surround decoder 510. The modification of the downmix signal representation is made in order to obtain more flexibility in the definition of the desired audio result. This is due to the fact that the MPEG Surround bitstream 522 cannot represent some mappings of the input signal of the MPEG Surround decoder 510 onto the upmix channel signals output by the MPEG Surround decoder 510. Accordingly, the modification of the downmix signal representation using the downmix transcoder 570 may bring along an increased flexibility.

Again, the rendering matrix generation 550 may take over the functionality of the apparatus 100 or the apparatus 240, thereby ensuring that audible distortions in the upmix signal representation provided by the MPEG Surround decoder 510 are kept sufficiently small.

5. Audio Signal Encoder According to FIG. 6

Figure 6:
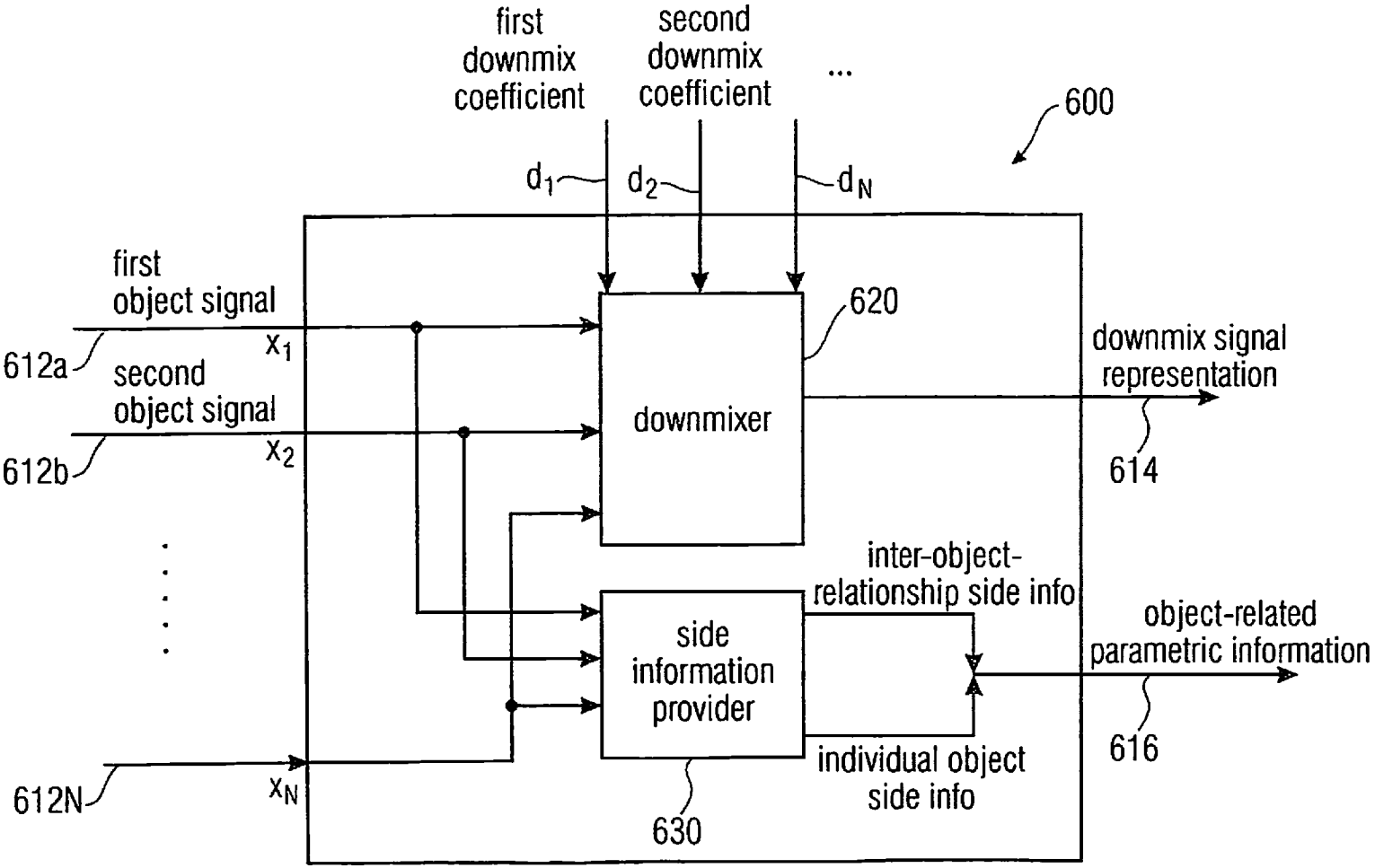
FIG. 6 shows a block schematic diagram of an audio signal encoder, according to an embodiment of the invention.

In the following, an audio signal encoder 600 will be described taking reference to FIG. 6, which shows a block schematic diagram of such an audio signal encoder. The audio signal encoder 600 is configured to receive a plurality of object signals 612*a*, 612N (also designated with $x_1$ to $x_N$) and to provide, on the basis thereof, a downmix signal representation 614 and an object-related parametric information 616. The audio signal encoder 600 comprises a downmixer 620 configured to provide one or more downmix signals (which constitute the downmix signal representation 614) in dependence on downmix coefficients $d_1$ to $d_N$ associated with the object signals, such that the one or more downmix signals comprise a superposition of a plurality of object signals. The audio signal encoder 600 also comprises a side information provider 630, which is configured to provide an inter-object-relationship side information describing level differences and correlation characteristics of two or more object signals 612*a* to 612N. The side information provider 630 is also configured to provide an individual-object side information describing one or more individual properties of the individual object signals.

The audio signal encoder 600 thus provides the object-related parametric information 616 such that the object-related parametric information comprises both an inter-object-relationship side information and the individual-object-side information.

It has been found that such an object-related parametric information, which describes both a relationship between object signals and individual characteristics of single object signals allows for a provision of a multi-channel audio signal in an audio signal decoder, as discussed above. The inter-object-relationship side information can be exploited by the audio signal decoder receiving the object-related parametric information 616 in order to extract, at least approximately, individual object signals from the downmix signal representation. The individual object side information, which is also included in the object-related parametric information 614, can be used by the audio signal decoder to verify whether the upmix process brings along too strong signal distortions, such that the upmix parameters (for example, rendering parameters) need to be adjusted.

The side information provider 630 is configured to provide the individual-object side information such that the individual-object side information describes a tonality of the individual object signals. It has been found that a tonality information can be used as a reliable criterion for evaluating whether the upmix process brings along significant distortions or not.

It should also be noted that the audio signal encoder 600 can be supplemented by any of the features and functionalities discussed herein with respect to audio signal encoders, and that the downmix signal representation 614 and the object-related parametric information 616 may be provided by the audio signal encoder 600 such that they comprise the characteristics discussed with respect to the inventive audio signal decoder.

6. Audio Bitstream According to FIG. 7

Figure 7:
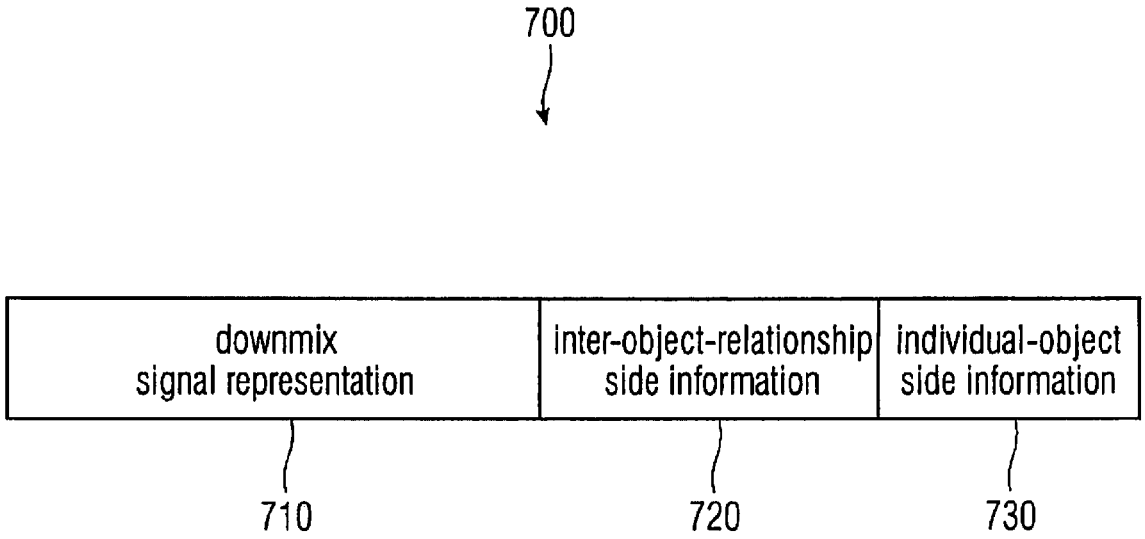
FIG. 7 shows a schematic representation of an audio bitstream, according to an embodiment of the invention.

An embodiment according to the invention creates an audio bitstream 700, a schematic representation of which is shown in FIG. 7. The audio bitstream represents a plurality of object signals in an encoded form.

The audio bitstream 700 comprises a downmix signal representation 710 representing one or more downmix signals, wherein at least one of the downmix signals comprises a superposition of a plurality of object signals. The audio bitstream 700 also comprises an inter-object-relationship side information 720 describing level differences and correlation characteristics of object signals. The audio bitstream also comprises an individual object side information 730 describing one or more individual properties of the individual object signals (which form the basis for the downmix signal representation 710).

The inter-object-relationship side information and the individual-object-information may be considered, in their entirety, as an object-related parametric side information.

In an embodiment, the individual-object side information describes tonalities of the individual object signals.

Naturally, as the audio bitstream 700 is typically provided by an audio signal encoder as discussed herein and evaluated by an audio signal decoder, as discussed herein. The audio bitstream may comprise characteristics as discussed with respect to the audio signal encoder and the audio signal decoder. Accordingly, the audio bitstream 700 may be well-suited for the provision of a multi-channel audio signal using an audio signal decoder, as discussed herein.

7. Conclusion

The embodiments according to the invention provide solutions for reducing or avoiding the distortion problem explained above, which originates from the fact that the single, original object signals cannot be reconstructed perfectly from the few transmitted downmix signals. There are more simple solutions to this problem thus be applied:

- A simplistic approach would be to limit the range of relative object gain to, e.g. +/−12 dB. While it is true, that large object gain settings can lead to audible degradations (example: boost one object by 20 dB while leaving the other object levels at 0 dB), this is, however, not necessitated: As an example, boosting all relative object levels by the same factor yields an unimpaired system output.
- A more elaborated view would be to look at the differences in relative object levels. For the rendering of two audio objects, the difference of both relative object levels indeed provides a hook for possible degradations in rendered output. It is, however, not clear how this idea generalizes to more than two rendered audio objects.

In view of this situation, embodiments according to the present invention provide means for addressing this problem and thus preventing an unsatisfactory user experience. Some embodiments may, according to the invention, bring along even more elaborate solutions than those discussed in the previous section.

Accordingly, a good hearing impression can be obtained by using the present invention, even if inappropriate rendering parameters are provided by a user.

Generally speaking, embodiments according to the invention relate to an apparatus, a method or a computer program for encoding an audio signal or for decoding an encoded audio signal, or to an encoded audio signal (for example, in the form of an audio bitstream) as described above.

8. Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal or audio bitstream can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[BCC] C. Faller and F. Baumgarte, "Binaural Cue Coding—Part II: Schemes and applications," IEEE Trans. on Speech and Audio Proc., vol. 11, no. 6, November 2003

[JSC] C. Faller, "Parametric Joint-Coding of Audio Sources", 120th AES Convention, Paris, 2006, Preprint 6752

[SAOC1] J. Herre, S. Disch, J. Hilpert, O. Hellmuth: "From SAC To SAOC—Recent Developments in Parametric Coding of Spatial Audio", 22nd Regional UK AES Conference, Cambridge, UK, April 2007

[SAOC2] J. Engdegård, B. Resch, C. Falch, O. Hellmuth, J. Hilpert, A. Hölzer, L. Terentiev, J. Breebaart, J. Koppens, E. Schuijers and W. Oomen: "Spatial Audio Object Coding (SAOC)—The Upcoming MPEG Standard on Parametric Object Based Audio Coding", 124th AES Convention, Amsterdam 2008, Preprint 7377

The invention claimed is:

1. An apparatus for providing one or more adjusted parameters for a provision of an upmix signal representation, which is an upmix audio signal representation, on the basis of a downmix signal representation, wherein several audio object signals are downmixed into the downmix signal, and an object-related parametric information, the apparatus comprising:

a receiving processor for receiving one or more input parameters;

a parameter adjuster configured to receive the one or more input parameters from the receiving processor and to provide, on the basis thereof, one or more adjusted parameters, wherein the parameter adjuster is configured to provide the one or more adjusted parameters in dependence on the one or more input parameters and the object-related parametric information, such that a distortion of the upmix signal representation caused by the use of non-optimal parameters is reduced at least for input parameters that deviate from optimal parameters by more than a predetermined deviation;

wherein the apparatus is configured to receive, as the input parameters, desired rendering parameters describing a desired intensity scaling of a plurality of audio object signals in one or more audio channels described by the upmix signal representation; and wherein the parameter adjuster is configured to provide one or more actual rendering parameters in dependence on the one or more desired rendering parameters and the object-related parametric information.

2. The apparatus according to claim 1, wherein the parameter adjuster is configured to acquire one or more rendering parameter limit values in dependence on the object-related parametric information and a downmix information, describing a contribution of the audio object signals to the downmix signal representation, such that a distortion metric, is within a predetermined range for rendering parameter values obeying limits defined by the rendering parameter limit values, and wherein the parameter adjuster is configured to acquire the actual rendering parameters in dependence on the desired rendering parameters and the one or more rendering parameter limit values, such that the actual rendering parameters obey the limits defined by the rendering parameter limit values.

3. The apparatus according to claim 1, wherein the parameter adjuster is configured to provide the one or more adjusted parameters in dependence on a computational measure of perceptual degradation, such that a perceptually evaluated distortion of the upmix signal representation caused by the use of non-optimal parameters and represented by the computational measure of perceptual degradation is limited.

4. The apparatus according to claim 1, wherein the parameter adjuster is configured to receive an individual-object property information describing the individual properties of one or more original object signals which form the basis for a downmix signal described by the downmix signal representation; and wherein the parameter adjuster is configured to consider the individual-object property information, and to provide the adjusted parameters such that a distortion of the upmix signal representation with respect to an ideally rendered upmix signal representation is reduced at least for input parameters deviating from optimal parameters by more than a predetermined deviation.

5. The apparatus according to claim 4, wherein the parameter adjuster is configured to receive and consider, as an individual object property information, an object signal tonality information, in order to provide the one or more adjusted parameters.

6. The apparatus according to claim 1, wherein the parameter adjuster is configured to perform a time-and-frequency-variant adjustment of the input parameters.

7. The apparatus according to claim 1, wherein the parameter adjuster is configured to also consider the downmix signal representation for providing the one or more adjusted parameters.

8. An apparatus for providing one or more adjusted parameters for a provision of an upmix signal representation on the basis of a downmix signal representation and an object-related parametric information, the apparatus comprising:

a receiving processor for receiving one or more input parameters;

a parameter adjuster configured to receive the one or more input parameters from the receiving processor and to provide, on the basis thereof, one or more adjusted parameters, wherein the parameter adjuster is configured to provide the one or more adjusted parameters in dependence on the one or more input parameters and the object-related parametric information, such that a distortion of the upmix signal representation caused by the use of non-optimal parameters is reduced at least for input parameters that deviate from optimal parameters by more than a predetermined deviation;

wherein the apparatus is configured to receive, as the input parameters, desired rendering parameters describing a desired intensity scaling of a plurality of audio object signals in one or more audio channels described by the upmix signal representation; and wherein the parameter adjuster is configured to provide one or more actual rendering parameters in dependence on the one or more desired rendering parameters;

wherein the parameter adjuster is configured to acquire the one or more rendering parameter limit values such that a relative contribution of an object signal in a rendered superposition of a plurality of object signals, rendered using one or more rendering parameters obeying the one or more rendering parameter limit values, differs from a relative contribution of the object signal in a downmix signal by no more than a predetermined difference.

9. The apparatus according to claim 8, wherein the parameter adjuster is configured to determine the one or more rendering parameter values $r_m$ such that the equation $$dm_1(m) = \frac{r_m^2 \cdot \sum_{i=1}^{N} d_i^2 \cdot X_i}{d_m^2 \cdot \sum_{i=1}^{N} r_i^2 \cdot X_i} \leq T$$

is fulfilled for one or more audio objects designated by an object index m, wherein $r_m$ designates a rendering parameter describing a contribution of an object signal of an audio object comprising object index m to a given channel of the upmix signal, wherein $d_m$ designates a downmix parameter describing a contribution of the object signal of the object comprising index m in a downmix signal, and when $X_i$ designates an energy measure of the audio object comprising object index m, which energy measure is determined by the object-related parametric information;

wherein T is a threshold value; and wherein i is a variable.

10. An apparatus for providing one or more adjusted parameters for a provision of an upmix signal representation on the basis of a downmix signal representation and an object-related parametric information, the apparatus comprising:

a receiving processor for receiving one or more input parameters;

a parameter adjuster configured to receive the one or more input parameters from the receiving processor and to provide, on the basis thereof, one or more adjusted parameters, wherein the parameter adjuster is configured to provide the one or more adjusted parameters in dependence on the one or more input parameters and the object-related parametric information, such that a distortion of the upmix signal representation caused by the use of non-optimal parameters is reduced at least for input parameters that deviate from optimal parameters by more than a predetermined deviation;

wherein the apparatus is configured to receive, as the input parameters, desired rendering parameters describing a desired intensity scaling of a plurality of audio object signals in one or more audio channels described by the upmix signal representation; and wherein the parameter adjuster is configured to provide one or more actual rendering parameters in dependence on the one or more desired rendering parameters;

wherein the parameter adjuster is configured to acquire the one or more rendering parameter limit values such that a distortion measure, which describes a coherence between a downmix signal described by the downmix signal representation and a rendered signal, rendered using one or more rendering parameters obeying the one or more rendering parameter limit values, is within a predetermined range.

11. The apparatus according to claim 10, wherein the parameter adjuster is configured to acquire the one or more rendering parameter limit values to $\hat{r}_m^2$ such that the distortion measure $$DM_3 = 1 - \min\left(\frac{|c_{12}|}{\sqrt{c_{11} \cdot c_{12}}}, 1\right)$$

takes a predetermined value, wherein C is defined as $$C = M \cdot E \cdot M^* = \begin{pmatrix} c_{11} & c_{12} \\ c_{21} & c_{22} \end{pmatrix};$$

wherein $$M = \begin{pmatrix} r_1 & r_2 & \dots & r_N \\ d_1 & d_2 & \dots & d_N \end{pmatrix}$$

is a matrix comprising a first row of rendering parameters $r_1$ to $r_n$ and a second row of downmix parameters $d_1$ to $d_n$ describing a contribution of the audio object signals to the downmix signal representation;

wherein E is an object covariance matrix which is acquired using parameters of the object-related parametric information, and wherein "*" designates a complex-conjugate operator.

12. An apparatus for providing one or more adjusted parameters for a provision of an upmix signal representation on the basis of a downmix signal representation and an object-related parametric information, the apparatus comprising:

a receiving processor for receiving one or more input parameters;

a parameter adjuster configured to receive the one or more input parameters from the receiving processor and to provide, on the basis thereof, one or more adjusted parameters, wherein the parameter adjuster is configured to provide the one or more adjusted parameters in dependence on the one or more input parameters and the object-related parametric information, such that a distortion of the upmix signal representation caused by the use of non-optimal parameters is reduced at least for input parameters that deviate from optimal parameters by more than a predetermined deviation;

wherein the apparatus is configured to receive, as the input parameters, desired rendering parameters describing a desired intensity scaling of a plurality of audio object signals in one or more audio channels described by the upmix signal representation; and wherein the parameter adjuster is configured to provide one or more actual rendering parameters in dependence on the one or more desired rendering parameters;

wherein the parameter adjuster is configured to compute a linear combination between a square of a desired rendering parameter and a square of an optimal rendering parameter, to acquire the actual rendering parameter, wherein the parameter adjuster is configured to determine a contribution of the desired rendering parameter and of the optimal rendering parameter to the linear combination in dependence on a predetermined threshold parameter T and a distortion metric, wherein the distortion metric describes a distortion which would be caused by using the one or more desired rendering parameters, rather than the optimal rendering parameters, for acquiring the upmix signal representation on the basis of the downmix signal representation.

13. The apparatus according to claim 12, wherein the parameter adjuster is configured to evaluate the equation $$r_{lim,m}^2 = \frac{T-1}{dm_x(m)}(r_m^2 - r_{opt,m}^2) + r_{opt,m}^2$$

in order to acquire the actual rendering parameter $r_{lim,m}$ describing a contribution of an object signal of an object comprising object index m to a given channel of the upmix signal, wherein T designates a predetermined distortion threshold parameter, wherein $dm_x$ designates a distortion metric associated with the desired rendering parameter $r_m$ describing a desired contribution of an object signal of an audio object comprising object index m to a given channel of the upmix signal;

wherein $r_{opt,m}$ designates an optimal rendering parameter describing an optimal contribution of an object signal of the audio object comprising object index m to the given channel of the upmix signal.

14. The apparatus according to claim 12, wherein the parameter adjuster is configured to acquire the distortion metric such that the distortion metric is dependent on a relationship between a relative contribution of a given object signal in a rendered superposition of a plurality of object signals, rendered in accordance with the desired rendering parameters, and a relative contribution of the given object signal in a downmix signal comprising the given object signal.

15. The apparatus according to claim 12, wherein the parameter adjuster is configured to acquire the distortion metric such that the distortion metric is dependent on a ratio between a relative contribution of a given object signal in a rendered superposition of a plurality of object signals, rendered in accordance with the desired rendering parameters, and a relative contribution of the given object signal in a downmix signal comprising the given object signal.

16. The apparatus according to claim 12, wherein the parameter adjuster is configured to compute the distortion metric $dm_x$ according to $$dm_x(m) = dm_1(m) = \frac{r_m^2 \sum_{i=1}^{N_{ob}} d_i^2 X_i}{d_m^2 \sum_{i=1}^{N_{ob}} r_i^2 X_i},$$

wherein $r_m$ and $r_i$ designate desired rendering parameters associated with audio objects comprising object indices m and i, respectively;

wherein $d_m$ and $d_i$ designate downmix parameters describing a contribution of object signals of audio objects comprising object indices m and i, respectively, to a downmix signal of the downmix signal representation;

wherein $N_{ob}$ designates a number of audio objects under consideration;

wherein $X_i$ designates energy measures associated with the object signals of the audio objects comprising object indices i.

17. The apparatus according to claim 12, wherein the parameter adjuster is configured to acquire the distortion metric such that the distortion metric is dependent on a difference between a relative contribution of a given object signal in a rendered superposition of a plurality of object signals, rendered in accordance with the desired rendering parameters, and a relative contribution of the given object signal in a downmix signal comprising the given object signal.

18. The apparatus according to claim 12, wherein the parameter adjuster is configured to compute the distortion metric such that the distortion metric is dependent on a mask-to-signal ratio, such that the distortion metric decreases, indicating a smaller distortion, if the mask-to-signal ratio increases.

19. The apparatus according to claim 12, wherein the parameter adjuster is configured to compute the distortion metric according to $$dm_x(m) = dm_2(m) = \frac{\left(r_m^2 \cdot \sum_{i=1}^{N} d_i^2 \cdot X_i - d_m^2 \cdot \sum_{i=1}^{N} r_i^2 \cdot X_i\right) \cdot X_m}{msr \cdot \left(\sum_{i=1}^{N} r_i^2 \cdot X_i\right) \cdot \left(\sum_{i=1}^{N} d_i^2 \cdot X_i\right)} \text{ or}$$

$$dm_x = dm_2'(m) = \frac{P_{Noise}}{\text{Mask}} = \frac{E\{|y_{m;Ideal} - \hat{y}_{m;actual}|^2\}}{msr \cdot P_{total}}$$

$$= \frac{\left|r_m^2 \cdot \sum_{i=1}^{N} d_i^2 \cdot X_i + d_m^2 \cdot \sum_{i=1}^{N} r_i^2 \cdot X_i - 2 \cdot d_m r_m \cdot \sqrt{\left(\sum_{i=1}^{N} r_i^2 \cdot X_i\right) \cdot \left(\sum_{i=1}^{N} d_i^2 \cdot X_i\right)}\right| \cdot X_m}{msr \cdot \left(\sum_{i=1}^{N} r_i^2 \cdot X_i\right) \cdot \left(\sum_{i=1}^{N} d_i^2 \cdot X_i\right)};$$

wherein $r_m$ and $r_i$ designate desired rendering parameters associated with audio objects comprising object indices m and i, respectively;

wherein $d_m$ and $d_i$ designate downmix parameters describing a contribution of object signals of audio objects comprising object indices m and i, respectively, to a downmix signal of the downmix signal representation;

wherein N designates a number of audio objects under consideration;

wherein $X_i$ and $X_m$ designate energy measures associated with the object signals of the audio objects comprising object indices i and m, respectively; and wherein msr defines a mask-to-signal ratio, wherein Mask defines a masking threshold;

wherein P designates a power, and wherein y designates values of a waveform.

20. An apparatus for providing one or more adjusted parameters for a provision of an upmix signal representation on the basis of a downmix signal representation and an object-related parametric information, the apparatus comprising:

a receiving processor for receiving one or more input parameters;

a parameter adjuster configured to receive the one or more input parameters from the receiving processor and to provide, on the basis thereof, one or more adjusted parameters, wherein the parameter adjuster is configured to provide the one or more adjusted parameters in dependence on the one or more input parameters and the object-related parametric information, such that a distortion of the upmix signal representation caused by the use of non-optimal parameters is reduced at least for input parameters that deviate from optimal parameters by more than a predetermined deviation;

wherein the parameter adjuster is configured to receive an individual-object property information describing the individual properties of one or more original object signals which form the basis for a downmix signal described by the downmix signal representation; and wherein the parameter adjuster is configured to consider the individual-object property information, and to provide the adjusted parameters such that a distortion of the upmix signal representation with respect to an ideally rendered upmix signal representation is reduced at least for input parameters deviating from optimal parameters by more than a predetermined deviation;

wherein the parameter adjuster is configured to receive and consider, as an individual object property information, an object signal tonality information, in order to provide the one or more adjusted parameters;

wherein the parameter adjuster is configured to estimate a tonality of an ideally rendered upmix signal in dependence on the received object signal tonality information and the received object power information; and wherein the parameter adjuster is configured to provide the one or more adjusted parameters to reduce a difference between the estimated tonality and the tonality of an upmix signal acquired using the one or more adjusted parameters when compared to a difference between the estimated tonality and a tonality of an upmix signal acquired using the one or more input parameters, or to keep a difference between the estimated tonality and a tonality of an upmix signal acquired using the one or more adjusted parameters within a predetermined range.

21. An apparatus for providing one or more adjusted parameters for a provision of an upmix signal representation on the basis of a downmix signal representation and an object-related parametric information, the apparatus comprising:

a receiving processor for receiving one or more input parameters;

a parameter adjuster configured to receive the one or more input parameters from the receiving processor and to provide, on the basis thereof, one or more adjusted parameters, wherein the parameter adjuster is configured to provide the one or more adjusted parameters in dependence on the one or more input parameters and the object-related parametric information, such that a distortion of the upmix signal representation caused by the use of non-optimal parameters is reduced at least for input parameters that deviate from optimal parameters by more than a predetermined deviation;

wherein the parameter adjuster is configured to acquire an overall distortion measure, that is a weighted combination of distortion measures describing a plurality of types of artifacts;

wherein the parameter adjuster is configured to acquire the overall distortion measure such that the overall distortion measure is a measure of distortions which would be caused by using one or more of the input rendering parameters, rather than optimal rendering parameters, for acquiring the upmix signal representation on the basis of the downmix signal representation.

22. The apparatus according to claim 21, wherein the parameter adjuster is configured to combine at least two of the following distortion measures in order to acquire the overall distortion measure:

a measure describing a parasitic change of timbre of an audio object;

a measure describing a parasitic modulation of an object signal associated with an audio object;

a measure describing the presence of a parasitic musical tone;

a measure describing the presence of a parasitic modulated noise.

23. An audio signal decoder for providing, as an upmix signal representation, a plurality of upmix audio channels on the basis of a downmix signal representation, an object-related parametric information and a desired rendering information, the audio signal decoder comprising:

an upmixer configured to acquire the upmixed audio channels on the basis of the downmix signal representation and in dependence on the object-related parametric information and an actual rendering information describing an allocation of a plurality of object signals of audio objects described by the object-related parametric information to the upmixed audio channels; and an apparatus for providing one or more adjusted parameters for a provision of an upmix signal representation on the basis of a downmix signal representation and an object-related parametric information, the apparatus comprising:

a parameter adjuster configured to receive one or more input parameters and to provide, on the basis thereof, one or more adjusted parameters, wherein the parameter adjuster is configured to provide the one or more adjusted parameters in dependence on the one or more input parameters and the object-related parametric information, such that a distortion of the upmix signal representation caused by the use of non-optimal parameters is reduced at least for input parameters that deviate from optimal parameters by more than a predetermined deviation, wherein the apparatus for providing one or more adjusted parameters is configured to receive, as the input parameters, desired rendering parameters describing a desired intensity scaling of a plurality of audio object signals in one or more audio channels described by the upmix signal representation; and wherein the parameter adjuster is configured to provide one or more actual rendering parameters in dependence on the one or more desired rendering parameters and the object-related parametric information;

wherein the apparatus for providing one or more adjusted parameters is configured to receive the desired rendering information as the one or more input parameters and to provide the one or more adjusted parameters as the actual rendering information; and wherein the apparatus for providing the one or more adjusted parameters is configured to provide the one or more adjusted parameters such that distortions of the upmixed audio channels caused by the use of the actual rendering parameters, which deviate from optimal rendering parameters, are reduced at least for desired rendering parameters deviating from the optimal rendering parameters by more than a predetermined deviation.

24. An audio signal transcoder for providing, as an upmix signal representation, a channel-related parametric information on the basis of a downmix signal representation, an object-related parametric information and a desired rendering information, the audio signal transcoder comprising:

a side information transcoder configured to acquire the channel-related parametric information on the basis of the downmix signal representation and in dependence on the object-related parametric information and an actual rendering information describing an allocation of a plurality of object signals of audio objects described by the object-related parametric information to upmix audio channels described by the channel-related parametric information; and an apparatus for providing one or more adjusted parameters for a provision of an upmix signal representation on the basis of a downmix signal representation and an object-related parametric information, the apparatus comprising:

a parameter adjuster configured to receive one or more input parameters and to provide, on the basis thereof, one or more adjusted parameters, wherein the parameter adjuster is configured to provide the one or more adjusted parameters in dependence on the one or more input parameters and the object-related parametric information, such that a distortion of the upmix signal representation caused by the use of non-optimal parameters is reduced at least for input parameters that deviate from optimal parameters by more than a predetermined deviation, wherein the apparatus for providing one or more adjusted parameters is configured to receive, as the input parameters, desired rendering parameters describing a desired intensity scaling of a plurality of audio object signals in one or more audio channels described by the upmix signal representation; and wherein the parameter adjuster is configured to provide one or more actual rendering parameters in dependence on the one or more desired rendering parameters and the object-related parametric information;

wherein the apparatus for providing one or more adjusted parameters is configured to receive the desired rendering information as the one or more input parameters and to provide the one or more adjusted parameters as the actual rendering information; and wherein the apparatus for providing the one or more adjusted parameters is configured to provide the one or more adjusted parameters such that distortions of the upmixed audio channels caused by the use of the actual rendering parameters, which deviate from optimal rendering parameters, are reduced at least for desired rendering parameters deviating from the optimal rendering parameters by more than a predetermined deviation.

25. A method for providing one or more adjusted parameters for a provision of an upmix signal representation, which is an upmix audio signal representation, on the basis of a downmix signal representation, wherein several audio object signals are downmixed into the downmix signal, and an object-related parametric information, the method comprising:

receiving one or more input parameters and providing, on the basis thereof, one or more adjusted parameters, wherein the one or more adjusted parameters are provided in dependence on the one or more input parameters and the object-related parametric information, such that a distortion of the upmix signal representation caused by the use of non-optimal parameters is reduced at least for input parameters deviating from optimal parameters by more than a predetermined deviation, wherein desired rendering parameters describing a desired intensity scaling of a plurality of audio object signals in one or more audio channels described by the upmix signal representation are received as the input parameters, and wherein one or more actual rendering parameters are provided in dependence on the one or more desired rendering parameters and the object-related parametric information, wherein the method is performed using a hardware apparatus, or using a computer, or using a combination of a hardware apparatus and a computer.

26. A method for providing, as an upmix signal representation, a plurality of upmixed audio channels on the basis of a downmix signal representation, an object related parametric information and a desired rendering information, the method comprising:

providing one or more adjusted parameters, wherein providing one or more adjusted parameters comprises:

receiving one or more input parameters and providing, on the basis thereof, one or more adjusted parameters, wherein the one or more adjusted parameters are provided in dependence on the one or more input parameters and the object-related parametric information, such that a distortion of the upmix signal representation caused by the use of non-optimal parameters is reduced at least for input parameters deviating from optimal parameters by more than a predetermined deviation, wherein the desired rendering information is received as the one or more input parameters and wherein the one or more adjusted parameters are provided as an actual rendering information, and wherein the one or more adjusted parameters are provided such that distortions of the upmixed audio channels caused by the use of the actual rendering parameters, which deviate from optimal rendering parameters, are reduced at least for desired rendering parameters deviating from the optimal rendering parameters by more than a predetermined deviation; and acquiring the upmixed audio channels on the basis of the downmix signal representation and in dependence on the object-related parametric information and the actual rendering information describing an allocation of a plurality of object signals of audio objects described by the object-related parametric information to the upmixed audio channels.

27. A method for providing, as an upmix signal representation, a channel-related parametric information on the basis of a downmix signal representation, an object-related parametric information and a desired rendering information, the method comprising:

providing one or more adjusted parameters, wherein providing one or more adjusted parameters comprises:

receiving one or more input parameters and providing, on the basis thereof, one or more adjusted parameters, wherein the one or more adjusted parameters are provided in dependence on the one or more input parameters and the object-related parametric information, such that a distortion of the upmix signal representation caused by the use of non-optimal parameters is reduced at least for input parameters deviating from optimal parameters by more than a predetermined deviation, wherein the desired rendering information is received as the one or more input parameters and wherein the one or more adjusted parameters are provided as an actual rendering information, and wherein the one or more adjusted parameters are provided such that distortions of the upmixed audio channels caused by the use of the actual rendering parameters, which deviate from optimal rendering parameters, are reduced at least for desired rendering parameters deviating from the optimal rendering parameters by more than a predetermined deviation; and acquiring the channel-related parametric information, which describes the upmixed audio channels, on the basis of the downmix signal representation and in dependence on the object-related parametric information and the actual rendering information describing an allocation of a plurality of object signals of audio objects described by the object-related parametric information to upmixed audio channels, which upmixed audio channels are described by the channel related parametric information.

28. A non-transitory computer readable medium comprising a computer program for performing one of the methods according to claims 25, 26, 27.

* * * * *